US011304539B2

(12) United States Patent
Tootell et al.

(10) Patent No.: US 11,304,539 B2
(45) Date of Patent: Apr. 19, 2022

(54) CHILD SUPPORT DEVICES USING LAYERED MESH MATERIAL

(71) Applicant: KIDS II, INC., Atlanta, GA (US)

(72) Inventors: Heather Tootell, Atlanta, GA (US); Casey Harris, Brookhaven, GA (US); Stephen Burns, Cumming, GA (US); Eric Lange, Atlanta, GA (US)

(73) Assignee: KIDS2, INC., Atlanta, GA (US)

( * ) Notice: Subject to any disclaimer, the term of this patent is extended or adjusted under 35 U.S.C. 154(b) by 70 days.

(21) Appl. No.: 16/333,006

(22) PCT Filed: Sep. 15, 2017

(86) PCT No.: PCT/US2017/051872
§ 371 (c)(1),
(2) Date: Mar. 13, 2019

(87) PCT Pub. No.: WO2018/053324
PCT Pub. Date: Mar. 22, 2018

(65) Prior Publication Data

US 2019/0274448 A1 Sep. 12, 2019

Related U.S. Application Data

(60) Provisional application No. 62/394,809, filed on Sep. 15, 2016.

(51) Int. Cl.
*A47D 9/02* (2006.01)
*A47D 15/00* (2006.01)
(Continued)

(52) U.S. Cl.
CPC ..... *A47D 9/02* (2013.01); *A47D 9/00* (2013.01); *A47D 13/02* (2013.01); *A47D 15/00* (2013.01)

(58) Field of Classification Search
CPC . A47D 9/02; A47D 9/00; A47D 13/02; A47D 15/00
See application file for complete search history.

(56) References Cited

U.S. PATENT DOCUMENTS 4,205,406 A * 6/1980 Wangkeo ..... A47D 9/02 5/98.1
4,366,587 A * 1/1983 Takada ..... B60N 2/2854 297/216.11

(Continued)

FOREIGN PATENT DOCUMENTS

KR 200473628 Y1 * 7/2014 ..... A47D 13/025
KR 200473628 Y1 7/2014

OTHER PUBLICATIONS

International Search Report for PCT/US2017/051872; dated Nov. 23, 2017; 5 pgs.

(Continued)

*Primary Examiner* — David R Hare
*Assistant Examiner* — Alexis Felix Lopez
(74) *Attorney, Agent, or Firm* — Gardner Groff & Greenwald, PC

(57) ABSTRACT

A child support device includes a seat and a panel included in or adjacent to the seat. The panel includes a first panel portion including a panel edge defining a panel opening. The first panel portion has a first heat transfer coefficient. A location of the panel opening corresponds to a heat transfer region in which an expected heat received from a child in the seat is greater than a heat reception threshold. A second panel portion is in the panel opening and attached to the panel edge. The second panel portion includes a layered mesh having a second heat transfer coefficient greater than the first heat transfer coefficient and greater than a threshold heat transfer coefficient at which a temperature of the second panel portion while receiving the expected heat is greater (Continued)

than a room temperature by less than a threshold difference, wherein the threshold difference is at most five degrees Fahrenheit.

19 Claims, 17 Drawing Sheets

(51) Int. Cl.
*A47D 13/02* (2006.01)
*A47D 9/00* (2006.01)

(56) References Cited

U.S. PATENT DOCUMENTS 4,783,862 A * 11/1988 Murphy ..... A47D 13/02 5/81.1 T
4,785,838 A * 11/1988 Negahdari ..... A47D 15/00 135/117
5,307,531 A * 5/1994 Kao ..... A47D 9/02 248/140
6,056,355 A * 5/2000 Klassen ..... A47D 15/00 297/184.1
6,256,965 B1 * 7/2001 Sheridan ..... A01K 1/0353 5/93.1
6,274,520 B1 * 8/2001 Cordell ..... A47G 9/0238 442/381
6,315,364 B1 * 11/2001 Fujita ..... D04B 21/12 297/452.56
6,485,103 B1 * 11/2002 Yamada ..... A47C 23/26 297/218.3
6,489,000 B1 * 12/2002 Ogura ..... A47C 23/26 428/45
7,055,192 B2 * 6/2006 Waters ..... A63H 3/02 5/424
2004/0261174 A1 * 12/2004 DeHart ..... A47D 5/00 5/93.1
2008/0136236 A1 * 6/2008 Kincaid ..... A47D 9/02 297/260.2
2009/0200844 A1 * 8/2009 Tibaldo ..... A47D 13/10 297/219.12
2010/0229300 A1 * 9/2010 Eirich ..... A47D 9/00 5/93.1
2011/0148159 A1 * 6/2011 Barron ..... A47D 5/00 297/219.12
2013/0097785 A1 * 4/2013 Cicci ..... A47D 15/008 5/663
2014/0096320 A1 * 4/2014 Wilson ..... A47D 15/008 5/424
2015/0342367 A1 * 12/2015 Corso ..... A47D 9/005 5/102

OTHER PUBLICATIONS

Written Opinion for PCT/US2017/051872; dated Nov. 23, 2017; 8 pgs.

* cited by examiner

CHILD SUPPORT DEVICES USING LAYERED MESH MATERIAL

CROSS-REFERENCE TO RELATED APPLICATIONS

The present application claims the benefit of and priority to U.S. Provisional Application No. 62/394,809, titled "BREATHABLE FABRIC", filed Sep. 15, 2016, the disclosure of which is incorporated herein by reference in its entirety.

TECHNICAL FIELD

The present disclosure relates generally to the field of child support devices. More particularly, the present disclosure relates to child support devices which use layered mesh material.

BACKGROUND

In existing child support devices, such as bassinets and sleepers, layered mesh may be provided for covering or connecting components of the child supports devices. For example, layered mesh may be provided as padding. However, layered mesh may be much more expensive than typical materials such as polyester-based materials (e.g., three to six times more expensive). Layered mesh also may perform more poorly than typical materials in standards testing for materials in child support devices. For example, layered mesh may perform more poorly in testing for manufacturing and durability factors, such as testing based on pulling apart material.

SUMMARY

One aspect of the present disclosure relates to a child support device. The child support device includes a seat and a panel included in or adjacent to the seat. The panel includes a first panel portion including a panel edge defining a panel opening. The first panel portion has a first heat transfer coefficient. A location of the panel opening corresponds to a heat transfer region in which an expected heat received from a child in the seat is greater than a heat reception threshold. A second panel portion is in the panel opening and attached to the panel edge. The second panel portion includes a layered mesh having a second heat transfer coefficient greater than the first heat transfer coefficient and greater than a threshold heat transfer coefficient at which a temperature of the second panel portion while receiving the expected heat is greater than a room temperature by less than a threshold difference, wherein the threshold difference is at most five degrees Fahrenheit.

Another aspect of the present disclosure relates to a bassinet. The bassinet includes a support frame including at least one leg and a child receiving portion supported by the at least one leg. The child receiving portion includes an upper frame member, a floor for supporting a child within the child receiving portion spaced apart from the upper frame member, and a sidewall extending between the upper frame member and the floor. The sidewall includes a layered mesh having a light transmittance coefficient. The light transmittance coefficient is less than a first threshold at which brightness of light passing into the child-receiving portion via the layered mesh decreases by thirty percent and greater than a second threshold at which the layered mesh is opaque to a view point outside the child receiving portion and located along an axis passing through the child receiving portion and the layered mesh.

Another aspect of the present disclosure relates to a child support device. The child support device includes a plurality of legs and a child receiving portion including an upper frame member coupled to the plurality of legs, a floor spaced from the upper frame member, and a sidewall extending between the floor and the upper frame member. The sidewall is configured to reduce a brightness of light through the sidewall by at least thirty percent. The sidewall has a heat transfer coefficient greater than a threshold value at which a temperature of the sidewall while receiving an expected heat corresponding to a child in the child receiving portion is no greater than eighty degrees Fahrenheit.

DETAILED DESCRIPTION

Referring to the Figures generally, in various embodiments, child support devices include layered mesh portions, which can improve operation of the child support devices by increasing light transmittance and/or heat dissipation while maintaining desired structural integrity. In some embodiments, a child support device includes a seat and a panel adjacent to the seat. The panel includes a first panel portion including a panel edge defining a panel opening. The first panel portion has a first heat transfer coefficient. A location of the panel opening corresponds to a heat transfer region in which an expected heat received from a child in the seat is greater than a heat reception threshold. A second panel portion is in the panel opening and attached to the panel edge. The second panel portion includes a layered mesh having a second heat transfer coefficient greater than the first heat transfer coefficient and greater than a threshold heat transfer coefficient at which a temperature of the second panel portion while receiving the expected heat is greater than a room temperature by less than a threshold difference, wherein the threshold difference is at most five degrees Fahrenheit. Child support devices can be, for example, play yards, bassinets, cribs, swings, sleepers, rockers, bouncers, car seats, high chairs, play gyms, and/or seats.

Figure 1A:
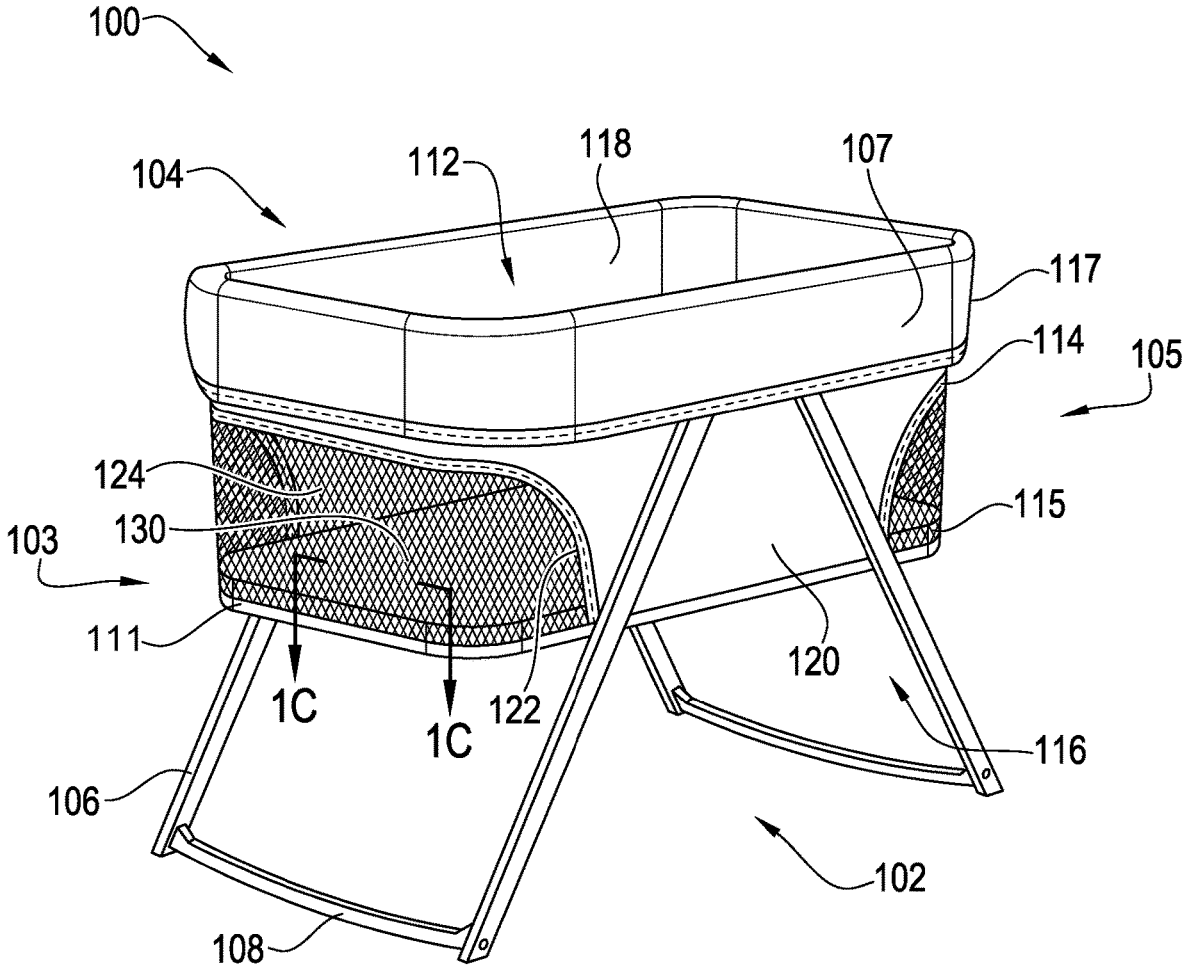
FIG. 1A is a perspective view of a child support device, according to an embodiment of the present disclosure.

Referring now to FIGS. 1A-1G, a child support device 100 is shown. The child support device 100 includes a support frame 102 including a support base 110 and a plurality of legs 106 attached to the support base 110. A liner floor 111 (e.g., made from fabric) is supported by the support frame 102. The support base 110 extends from a first end 103 to a second end 105 of the child support device 100. As shown in FIG. 1A, the support legs 106 extend from a center 107 of the child support device 100 (e.g., the support legs 106 may join at the center 107). The legs 106 include a floor support 108, in some embodiments, extending between adjacent legs 106 (e.g., a first floor support 108 extending between adjacent legs 106 at the first end 103 of the child support device 100 and a second floor support 108 extending between adjacent legs 106 at the second end 105 of the child support device 100). In some embodiments, the floor supports 108 include a curved surface 109. The floor supports 108 can pivot from a first position (see FIG. 1F) to a second position (see FIG. 1G) at which the curved surface 109 faces away from the child receiving portion 104 to contact a support surface, which allows the child support device 100 to be rocked on the curved surfaces 109.

The child support device 100 also includes a child receiving portion 104. The child receiving portion 104 is supported by the support frame 102, including the legs 106 of the support frame 102. The child receiving portion 104 is above the liner floor 111 and defines an open space 112. In some embodiments, the child receiving portion 104 includes a pad 130 (e.g., mattress) on the liner floor 111 between the liner floor 111 and the open space 112. The pad 130 can include a layered mesh (e.g., a layered mesh as described below). The pad 130 may include multi-layer pad including a first, non-woven layer, a second polyester layer (e.g., batting for softness and/or springiness), and a third, tactile layer (e.g., facing the open space 112, the third layer being soft and/or non-abrasive, such as by including at least one of a boa, polyester, or brushed polyester material).

The child receiving portion 104 includes a panel 114 (e.g., sidewall). The panel 114 is attached to the floor liner 111, in some embodiments, and extends from a base end 115 to an upper end 117. A perimeter of the upper end 117 at least partially defines an opening of the open space 112.

The panel 114 may include an upper member 118 attached to or extending from the upper end 117 of the panel 114. In some embodiments, the upper member 118 is a padded member. For example, the upper member 118 can include fabric material having a greater thickness than the panel 114.

As shown in the embodiment of FIG. 1A, the panel 114 includes a first panel portion 120. The first panel portion 120 is made of a first material. The first material may include polyester. In some embodiments, the first panel portion 120 is a multi-layer pad including a first, non-woven layer, a second polyester layer (e.g., batting for softness and/or springiness), and a third, tactile layer disposed on an inner face of the panel 114 (e.g., facing the open space 112, the third layer being soft and/or non-abrasive, such as by including at least one of a boa, polyester, or brushed polyester material).

The first panel portion 120 has a first heat transfer coefficient. The first heat transfer coefficient can include at least one of a radiative heat transfer coefficient for radiation by the first panel portion 120, a convective heat transfer coefficient for convective heat transfer from the first panel portion 120 to surrounding air, and a conductive heat transfer coefficient for conduction through the first panel portion 120. In some embodiments, the first heat transfer coefficient is an average value taken over a surface area of the first panel portion 120.

The first panel portion 120 has a first light transmittance. The first light transmittance indicates a ratio of light transmitted through the first panel portion 120 (e.g., from outside the child-receiving portion 104 into the open space 112) to light received by the first panel portion 120 (e.g., received on the outer surface of the first panel portion 120). The first light transmittance may be a light transmittance of visible light (e.g., approximately 390 to 700 nm). In some embodiments, the first light transmittance is an average value taken over the surface area of the first panel portion 120. In some embodiments, the first panel portion 120 is opaque to visible light.

The first panel portion 120 has a first stiffness. The first stiffness indicates an amount of displacement the first panel portion 120 will undergo in response to a force applied on the first panel portion 120 (e.g., a child resting on or pushing against the first panel portion 120 from inside the child receiving portion 104). In some embodiments, the first stiffness is defined as an average value taken over the surface area of the first panel portion 120.

It will be appreciated that the displacement of the first panel portion 120 may be limited by structural elements of the child support device 100, such as the relatively rigid or hard legs 106. However, it may be undesirable for the child support device 100 to extensively include rigid/hard elements, such as the legs 106, for support (e.g., to support portions of the panel 114 including the first panel portion 120 as well as the second panel portion 124 described below), as such elements may increase the cost, manufacturing complexity, and/or lack of comfort for a child occupant of the child support device 100.

The first panel portion 120 includes a panel edge 122 defining a panel opening in which a second panel portion 124 is located. The second panel portion 124 is attached to the panel edge 122, such as by being stitched, sewn, or adhered to the panel edge 122.

Figure 1B:
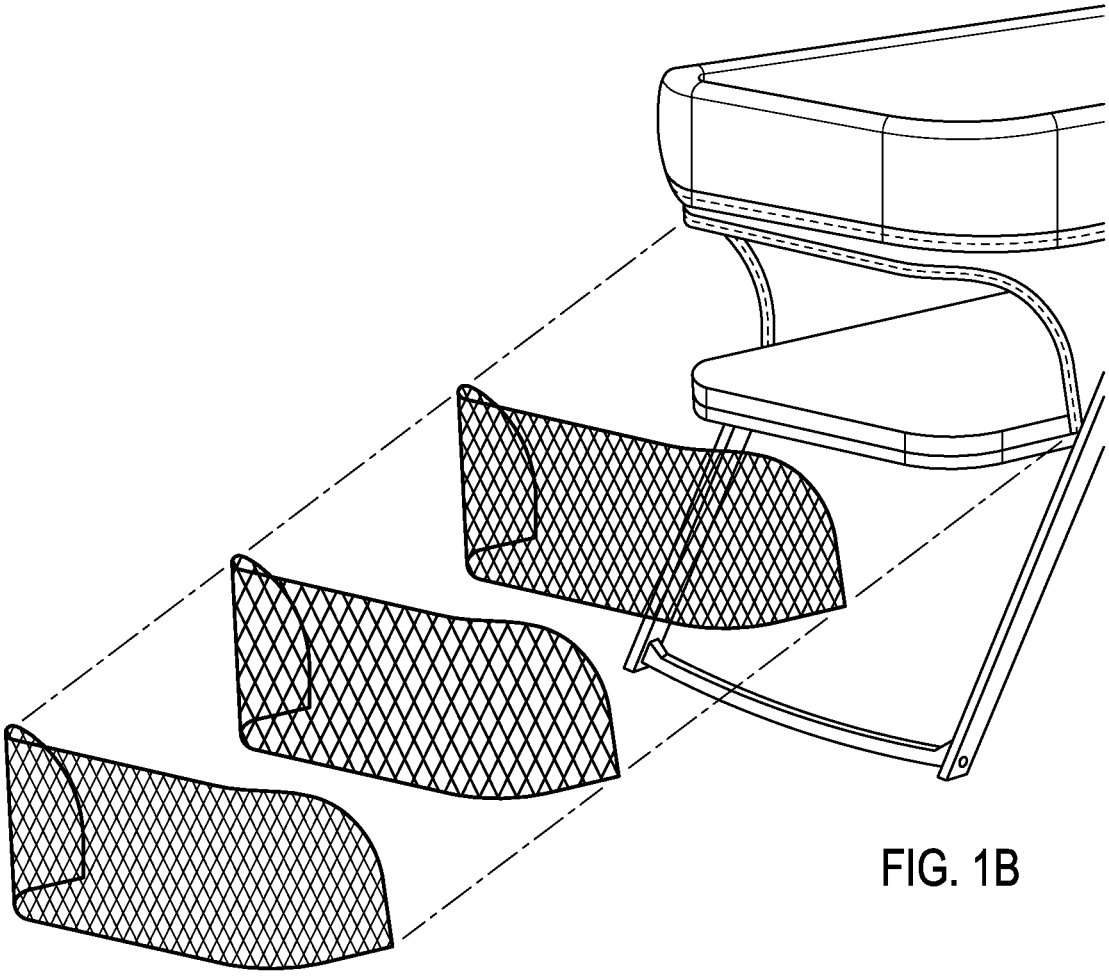
FIG. 1B is an exploded view of the child support device of FIG. 1A, according to an embodiment of the present disclosure.
Figure 1C:
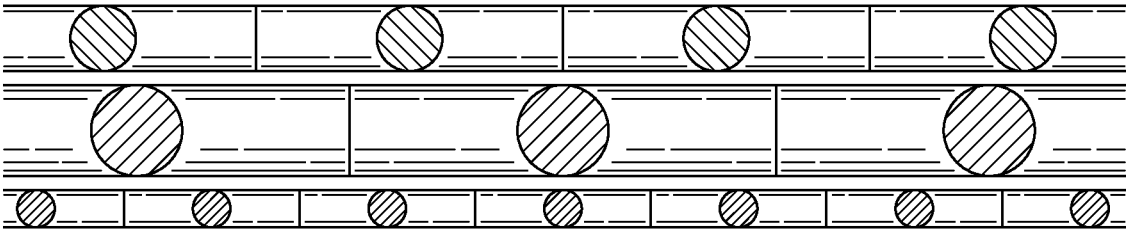
FIG. 1C is a cross-sectional view of the child support device of FIG. 1A, according to an embodiment of the present disclosure.

The second panel portion 124 includes a layered mesh. In some embodiments, the layered mesh includes a first layer of material, a second layer of material, and an intermediate layer of material positioned between the first and second layers, as shown in FIGS. 1B-1C. The first and second layers can be formed from mesh material or other breathable material. The intermediate layer can be formed from a spacer mesh material, such as one or more thread-like filaments from a flexible material such as polyester. In some embodiments, the intermediate layer has a thickness greater than a thickness of the first layer and of the second layer. The layered mesh can have a pattern formed by sonic welding, stitching, screen-printing, chemical cutting, and/or embossing. The layered mesh can have a thickness greater than 1/16 inch and less than ½ inch.

The layered mesh can have a greater strength and rigidity than a single layer arrangement. The layered mesh can filter out more light than a single layer arrangement, which can be beneficial when used on sleep support devices for children, such as bassinets, cribs, or play yards. In some embodiments, the layered mesh provides greater cushioning than a single layer arrangement, and thus may be more safe and/or comfortable than a single layer arrangement for a child who comes into contact with the layered mesh. The layered mesh may facilitate greater air flow through the second panel portion 124, which can reduce the risk of suffocation while aiding in transferring heat away from a child in contact with the second panel portion 124.

The second panel portion 124 (e.g., the layered mesh thereof) has a second heat transfer coefficient, which can be defined in a similar manner as the first heat transfer coefficient, including being defined as an average value taken over a surface area of the second panel portion 124. The second panel portion 124 also has a second light transmittance, which can be defined in a similar manner as the first light transmittance. The second panel portion 124 has a second rigidity, which can be defined in a similar manner as the first rigidity.

In some embodiments, the panel edge 122 (and thus the panel opening in which the second panel portion 124 is attached) is at a location corresponding to a heat transfer region in which an expected heat received from a child in the child receiving portion 104 is greater than a heat reception threshold. The heat transfer region and heat reception threshold may be determined based on testing of usage of a child support device incorporating material of the first panel portion and/or the second panel portion.

Heat Transfer Test Examples

Heat transfer regions can be determined by testing materials of the child support device 100 for heat transfer behavior in response to receive expected heat loads. Such testing can inform selection of locations for incorporating layered mesh material in the child support device 100. A seatpad can be used to represent the child support device 100, and a heat source, such as a heating blanket, can be used to transfer heat to the seatpad. One or more temperature sensors may be used to monitor temperature of the seatpad as a function of time. Temperature as a function of time may be used to identify regions of the seatpad which are relatively hot (e.g., greater than room temperature by more than a threshold temperature difference), as well as to calculate heat transfer coefficients for materials of the seatpad.

In one example procedure, a heating blanket was placed on atop side of a seatpad, and a first thermometer probe was placed between the heating blanket and the seatpad. A second thermometer probe was secured to a bottom side of the seatpad (e.g., on an opposite side from the first thermometer probe, to facilitate determination of a spatial temperature profile through the seatpad). At an initial time point, the heating blanket was turned on to begin transferring heat to the seatpad. After ten minutes, first temperatures were recorded from each of the first and second thermometer probes; in addition, a first thermal image was captured using a thermal imager. Heating of the seatpad was then discontinued by disconnecting the heating blanket. After an additional ten minutes, second temperatures were recorded from each of the first and second thermometer probes, and a second thermal image was captured. Table 1 below provides example experimental data from this procedure, indicating the advantages can provide for increasing thermal conductivity through the seatpad, convective heat transfer from the seatpad, and in turn an overall heat transfer coefficient (and thus overall heat dissipation) for the seatpad. It will be appreciated that the temperature difference between the top side and bottom side temperature readings is inversely proportional to thermal conductivity of the seatpad, while the temperature differences over time (between top side readings and between bottom side readings) are inversely proportional to the heat transfer coefficient for the seatpad.

TABLE 1

| Seatpad | Side | Start Temp (DegF.) | Temp Diff (through seatpad) | End Temp | Temp Diff (through seatpad) | Time (min) | Temp Diff (after time) |
|---|---|---|---|---|---|---|---|
| Material 1 | Top | 103 | 19 | 93 | 12 | 10 | 10 |
| | Bottom | 84 | | 81 | | | 3 |
| Mesh | Top | 93 | 1 | 88 | 2 | 10 | 5 |
| | Bottom | 92 | | 86 | | | 6 |
| Material 2 | Top | 95 | 19 | 90 | 15 | 10 | 5 |
| | Bottom | 76 | | 75 | | | 1 |
| Mesh w/ bolster | Top | 112 | 19 | 104 | 17 | 10 | 8 |
| | Bottom | 93 | | 87 | | | 6 |
| Material 2 w/ bolster | Top | 107 | 31 | 105 | 30 | 10 | 2 |
| | Bottom | 76 | | 75 | | | 1 |

As shown in Table 1, the use of mesh material in the seatpad increased the thermal conductivity of the seatpad (compare, for example, temperature difference through the seatpad for the Mesh example to temperature difference through the seatpad for Material 1 and Material 2 examples). Similarly, even where a bolster was provided to the seatpad, increasing the thickness (and thus resistance to conductive heat transfer through the seatpad) of the seatpad, the temperature difference through the seatpad was less than for the Material 2 with bolster example. Similar results for temperature over time indicated an improved heat transfer coefficient for the Mesh examples.

It will be appreciated that the procedure described above can be used to identify locations on child support devices (e.g., child support device 100) susceptible to receiving and/or storing disproportionate amounts of heat over time (resulting in heat buildup). For example, a heat source, such as the heat blanket, can be placed in specific locations on the child support device 100, and temperature can be monitored over time across locations to determine spatial variations in heat dissipation. For example, in the present test examples, a heating blanket was provided for the heat source rather than relying on the expected heat of the child (i.e., the heat a child is expected to generate or output), for example, which may generally be between a temperature range of about 85-105 degrees Fahrenheit. However, since these tests and materials as noted herein would respond similarly regardless of the heat source, a heating blanket was provided for conducting the test examples. Usage of the child support device 100 by a child occupant may be monitored or estimated as well to identify locations which would be susceptible to heat buildup (e.g., areas where a child occupant might tend to rest legs, the lower back, shoulders, the head, when using the child support device 100). In various embodiments, a heat map may be generated based on this information, and used to determine targeted locations for including layered mesh material in the child support device 100.

As shown in FIG. 1A, the child support device 100 includes two second panel portions 124 disposed towards first end 103 and second end 105, respectively. In various embodiments, the child support device 100 can include various numbers and geometries of second panel portions 124 incorporating layered mesh, such as to correspond to regions at which heat dissipation is especially desired. For example, the second panel portions 124 may be formed in alternating geometries with first panel portions 120, such as alternating rectangles (e.g., stripes), in a grid geometry, in a cross-hatched or diamond alternating geometry, in alternating, slanted members, or any other such geometries.

The second heat transfer coefficient is greater than the first heat transfer coefficient. As such, the second panel portion 124 may improve comfort for a child in the child support device 100 by increasing a rate of heat transfer out of the child support device 100 compared to a device which does not include the second panel portion 124 (e.g., includes material of the first panel portion 120 instead of the layered mesh of the second panel portion 124), particularly from areas where the child support device 100 has been determined to be susceptible to high temperatures.

In some embodiments, the second heat transfer coefficient is also greater than a threshold heat transfer coefficient. The threshold heat transfer coefficient may correspond to a heat transfer coefficient at which the second panel portion 124 is able to dissipate heat so that a temperature of the child support device 100 is not significantly greater than a surrounding room temperature. For example, the threshold heat transfer coefficient may be a value at which a temperature of the second panel portion 124 while receiving the expected heat from the child in the child receiving portion 104 is greater than the room temperature by less than a threshold difference. In some embodiments, the threshold difference is less than or equal to ten degrees Fahrenheit. The threshold heat transfer coefficient may also be a value at which the temperature of the second panel portion 124 while receiving the expected heat from the child in the child receiving portion 104 is greater than a temperature of the first panel portion 120 by less than a threshold difference.

The second light transmittance is greater than the first light transmittance. As such, the second panel portion 124 may improve visibility into the child receiving portion 104 through the second panel portion 124, as compared to the first panel portion 120, such as when the first panel portion 120 is opaque. At the same time, it may be desirable to limit the increase in light transmittance of the second panel portion 124 relative to the first panel portion to limit the amount of light entering the child receiving portion 104. This may improve comfort for the child, such as by making it easier for the child to sleep in lighted areas, such as in rooms having point light sources. In some embodiments, the second light transmittance coefficient is (1) less than a first threshold at which brightness of light passing into the child receiving portion 104 via the second panel portion 124 decreases by a threshold percentage, and (2) greater than a second threshold at which the second panel portion 124 (or the child receiving portion 104) is opaque to a view point outside the child receiving portion 104 and located along an axis passing through the child receiving portion 104 and the layered mesh 104. The threshold percentage may be thirty percent (e.g., the brightness of light within the child receiving portion 104 is at most seventy percent as bright as outside the child receiving portion 104).

Figure 1D:
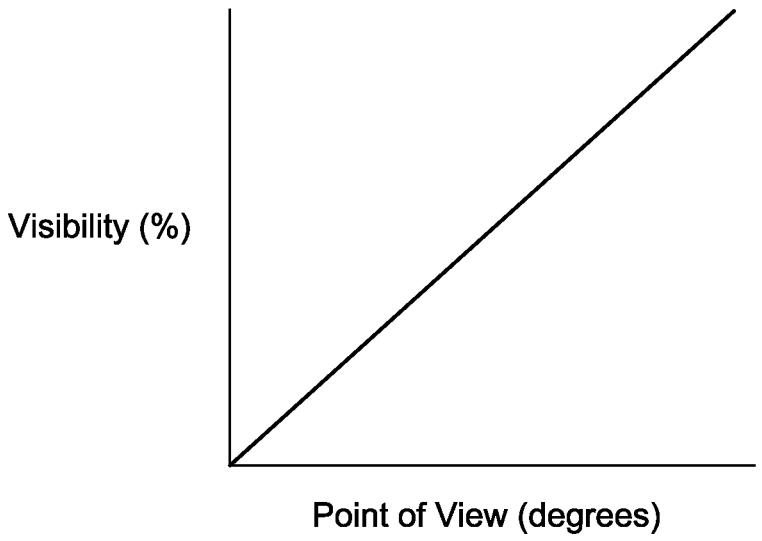
FIG. 1D is a graphical view of how visibility changes as point-of-view changes with respect to the child support device of FIG. 1A, according to an embodiment of the present disclosure.
Figure 1E:
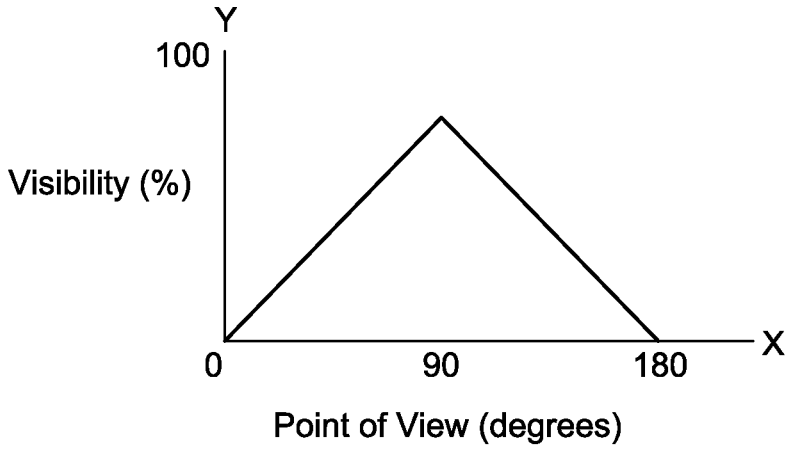
FIG. 1E is an alternate graphical view of how visibility changes as point-of-view changes with respect to the child support device of FIG. 1A, according to an embodiment of the present disclosure.
Figure 1F:
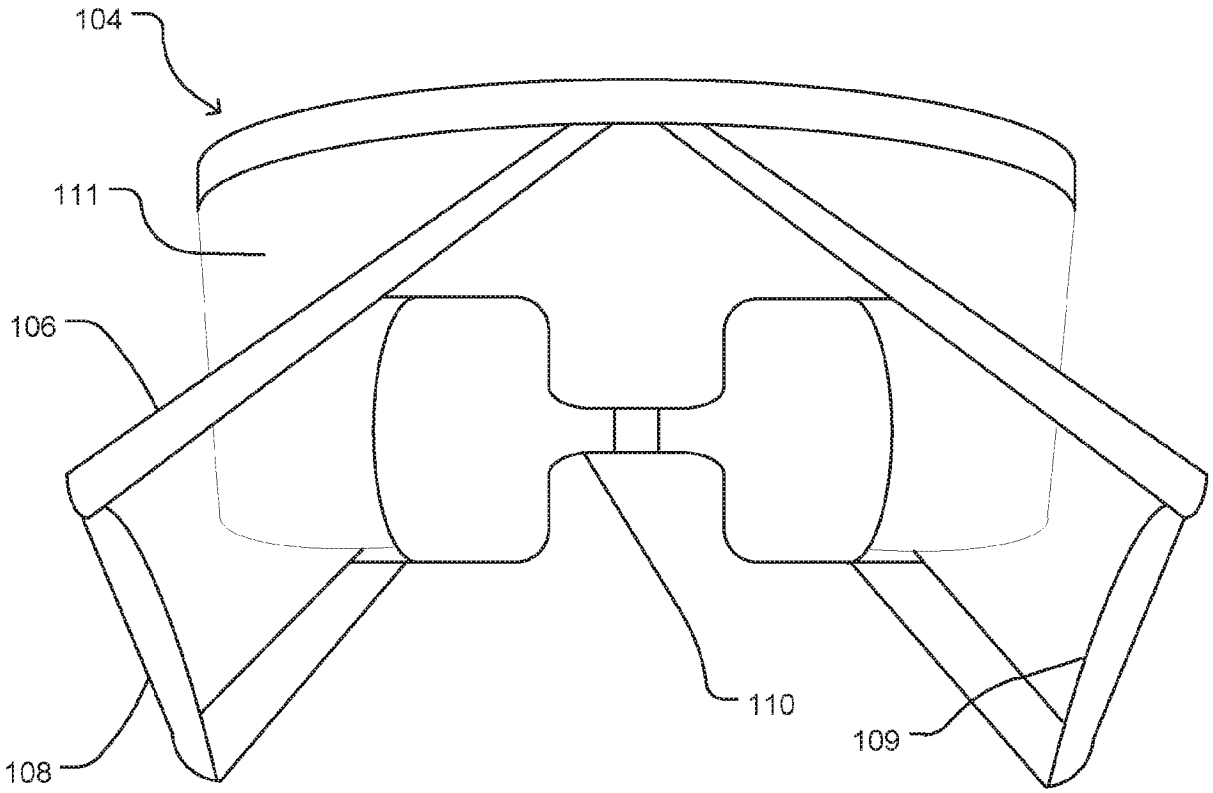
FIG. 1F is a bottom view of the child support device of FIG. 1A with floor supports in a first arrangement, according to an embodiment of the present disclosure.
Figure 1G:
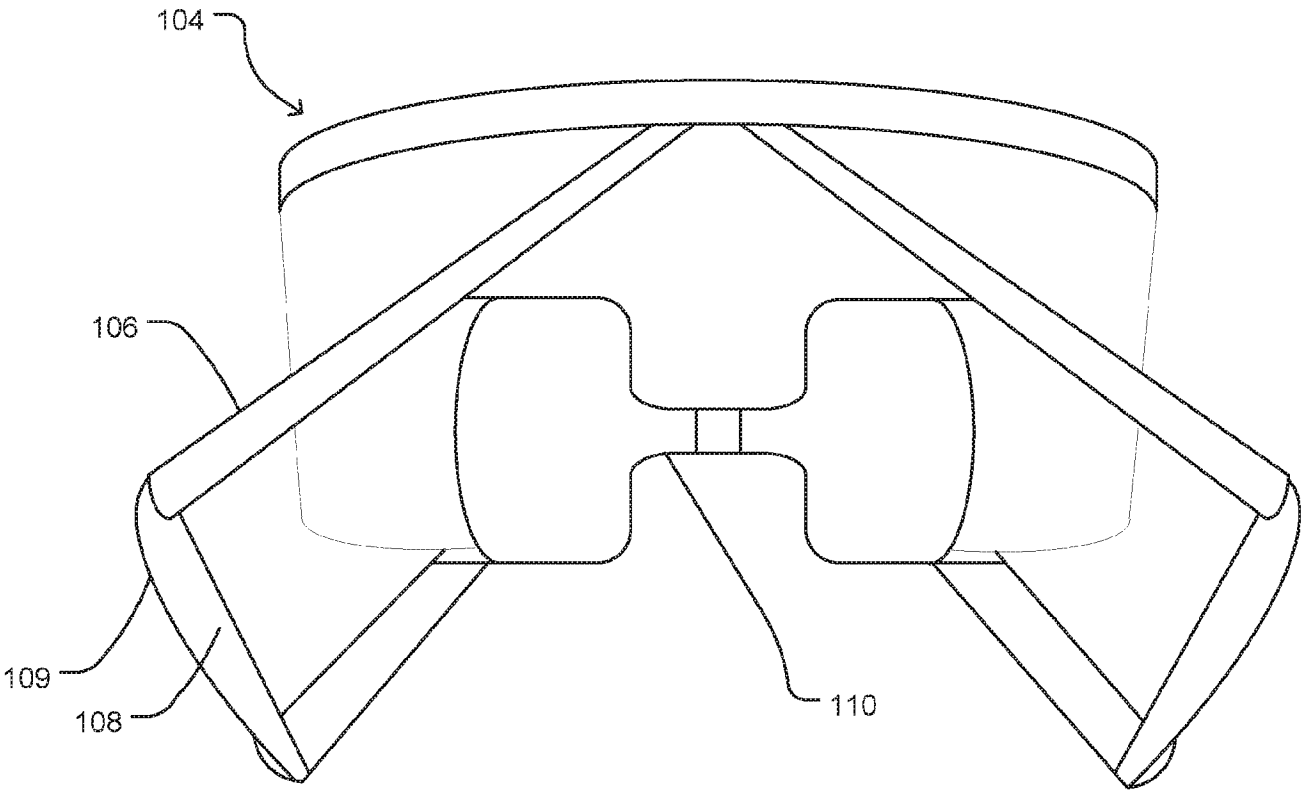
FIG. 1G is a bottom view of the child support device of FIG. 1A with floor supports in a second arrangement, according to an embodiment of the present disclosure.

The second threshold may be a threshold at which the second panel portion 124 appears to be opaque to the view point outside the child receiving portion 104, as shown in FIGS. 1D-1E. It will be appreciated that the visibility of the open space 112 through the second panel portion 124 from the view point outside the child receiving portion 104 may depend on a distance from the view point to the second panel portion 124, an angle from the view point to the surface of the second panel portion 124, and a mesh size of the layered mesh (e.g., a ratio of the open spaces across the surface area of the layered mesh material to the total surface area encompassed by the perimeter of the layered mesh). For example, the visibility of the open space 112 may decrease as the distance increases; increase as the mesh size increases; and decrease if the angle increases (e.g., from zero degrees when orthogonal to the surface of the second panel portion 124 to ninety degrees when parallel to the surface of the second panel portion 124). The second threshold may thus be determined based on predetermined values or ranges of values for the distance, angle, and/or mesh size. For example, the second threshold may be determined based on an angle corresponding to a predetermined eye level for an adult (e.g., approximately sixty to seventy inches) and a predetermined distance from which the adult would expect to be able to see into the child support device 100 (e.g., ten feet).

In some embodiments, the second stiffness of the second panel portion 124 is less than the first stiffness of the first panel portion 120. To ensure that the child support device 100 provides sufficient structural support to a child in the child support device 100, a ratio of the surface areas of the first panel portion 120 and second panel portion 124 may be selected. In some embodiments, a ratio of a surface area of the first panel portion 120 to a surface area of the second panel portion is greater than a threshold ratio at which an average stiffness of the panel 114 is at least a threshold percentage of the first stiffness (e.g., at least fifty percent). In some embodiments, the surface area of the second panel portion 124 forms less than fifty percent of the surface area of the panel 114.

In other embodiments, the second stiffness of the second panel portion 124 is more than the first stiffness of the first panel portion 120. This may allow the second panel portion 124 to be used to selectively reinforce the first panel portion 120 when the first panel portion 120 is made from relatively flimsy material (e.g., this may allow a relatively thin material to be used for the first panel portion 120, while reinforcement by the relatively stiff second panel portion 124 can ensure compliance with requirements for material strength for the child support device 100). An average stiffness of the panel 114 may similarly be configured to be at least a threshold percentage of the second stiffness of the second panel portion 124 to ensure sufficient rigidity throughout the panel 114.

Figure 2:
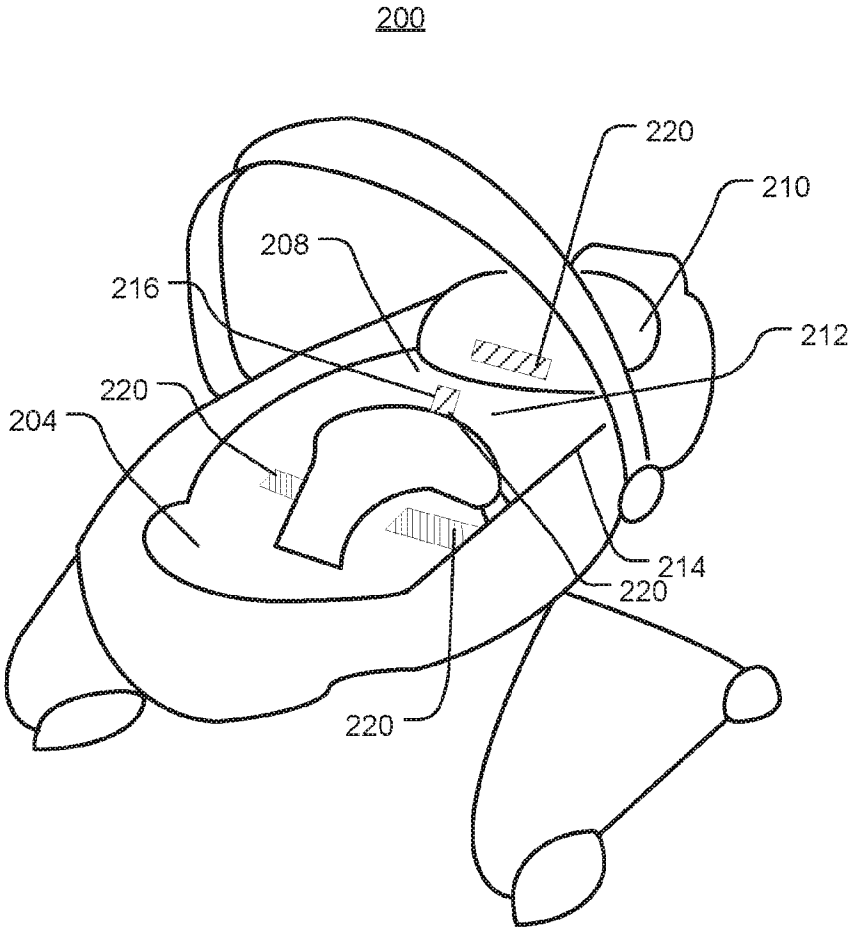
FIG. 2 is a perspective view of a child support device including a seat and a panel, according to an embodiment of the present disclosure.

Referring now to FIG. 2, a child support device 200 is shown. The child support device 200 can incorporate features of the child support device 100 described with reference to FIG. 1. As shown in FIG. 2, the child support device 200 includes a seat 204 for supporting a child in the child support device 200. A back panel 208 extends from the seat 204. In some embodiments, the back panel 208 is integrally formed with the seat 204. The back panel 208 can provide comfort and support to a child in the seat 204. A headrest 210 may extend from the back panel 208 to further support a head of a child. A seat restraint 222 may be provided to secure the child in the child support device 200.

The back panel 208 includes a first panel portion 212, which is similar to the first panel portion 120 of FIG. 1. The first panel portion 212 includes a panel edge 216 defining a panel opening. A second panel portion 220 is located in the panel opening defined by the panel edge 216, and is attached to the panel edge 216. The second panel portion 220 is similar to the second panel portion 124 of FIG. 1, and includes a layered mesh material. As shown in FIG. 2, the child support device 200 includes multiple second panel portions 220 (e.g., in back panel 208, in seat 204, in headrest 210). The second panel portion 220 may be provided on a seat-facing side (not shown) of the seat restraint 222. In various embodiments, one or more such second panel portions 220 may be provided in various locations of the child support device 200, based on factors such as desired heat dissipation, material cost, durability, and rigidity, as described with reference to FIGS. 1A-1G.

The first panel portion 212 has a first heat transfer coefficient, and the second panel portion 220 has a second heat transfer coefficient that is greater than the first heat transfer coefficient. In some embodiments, a location of the panel edge 216 (and thus the panel opening defined by the panel edge 216) corresponds to a heat transfer region in which an expected heat received from a child in the seat is greater than a heat reception threshold. Because of the layered mesh of the second panel portion 220, a temperature of the panel 208 (e.g., of the second panel portion 220 thereof) is greater than a surrounding room temperature by less than a threshold difference (e.g., at most ten degrees Fahrenheit; at most five degrees Fahrenheit; at most two degrees Fahrenheit) while receiving the expected heat.

In some embodiments, a size ratio of the first panel portion 212 to the second panel portion 220 is greater than a threshold ratio. The threshold ratio may correspond to a ratio at which an average stiffness of the panel 208 is at least a threshold percentage of a first stiffness of the first panel portion 212 (e.g., at least fifty percent). A distance from the panel edge 216 to a perimeter 214 of the first panel portion 208 and/or a ratio of surface areas of the first panel portion 212 and second panel portion 220 may define the size ratio.

Figure 3:
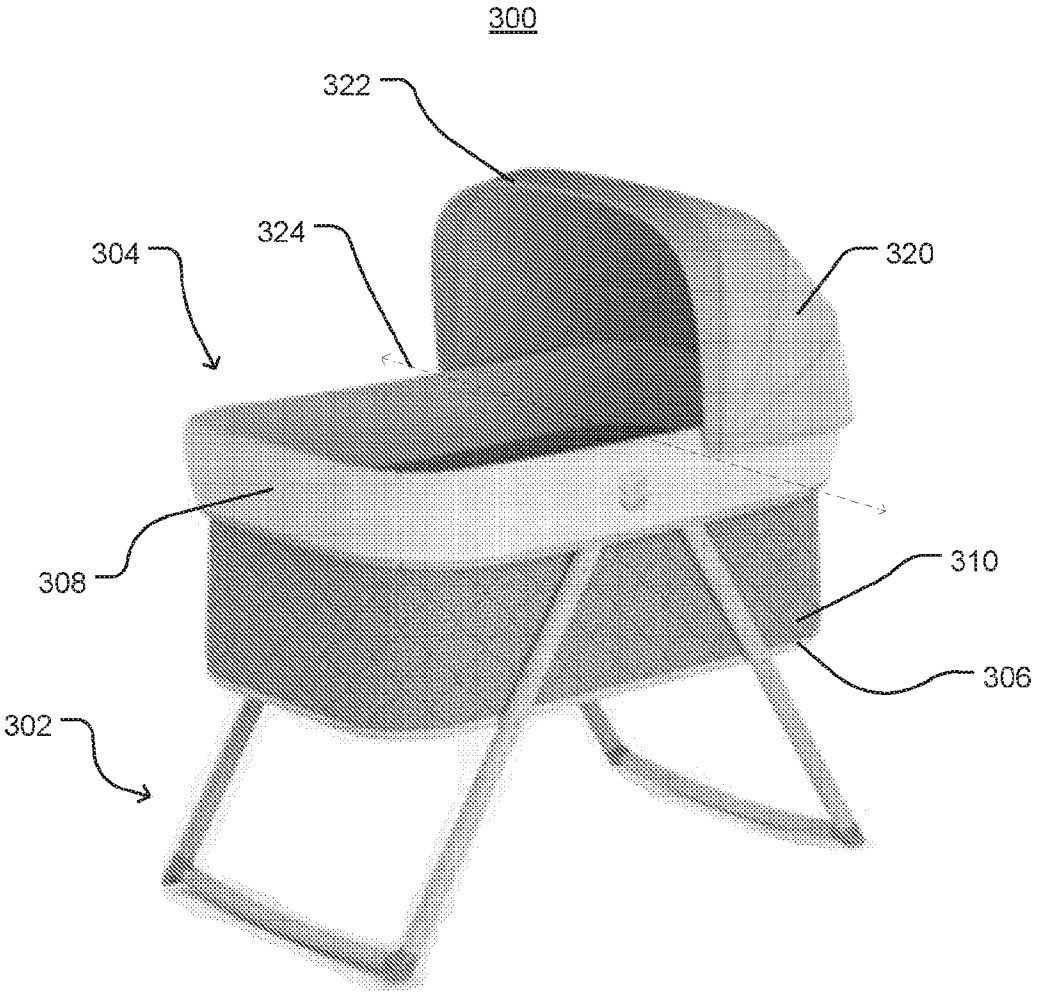
FIG. 3 is a perspective view of a child support device including a canopy, according to an embodiment of the present disclosure.

Referring now to FIG. 3, a child support device 300 is shown. The child support device 300 can incorporate features of the child support devices 100, 200. As shown in FIG. 3, the child support device 300 includes a support frame 302 and a child receiving portion 304 supported by the support frame 302. The child receiving portion 304 includes a support base 306, an upper frame member 308, and a sidewall 310 extending from the support base 306 to the upper frame member 308. The sidewall 310 includes a layered mesh, similar to the second panel portion 124 describe with reference to FIG. 1. In some embodiments, a substantial portion of the sidewall 310 (e.g., greater than fifty percent; greater than eighty percent; greater than ninety-nine percent; all) of the sidewall 310 is made from a layered mesh. As shown in FIG. 3, the entire sidewall 310 is made from layered mesh.

The child support device 300 includes a canopy 320. The canopy 320 is coupled to the upper frame member 308 and extends over the child receiving portion 304. In some embodiments, a leading end 322 of the canopy 320 can be rotated about an axis 324 to adjust an extent by which the upper frame member 308 extends over the child receiving portion 304.

The canopy 320 includes a layered mesh, which can enable the canopy 320 to reduce a brightness of light transmitted through the canopy 320 into the child receiving portion 304. In some embodiments, the canopy 320 reduces the brightness of light by at least a threshold percentage (e.g., at least thirty percent). In some embodiments, the canopy is opaque to a view point along an axis extending through the canopy 320.

Figure 4:
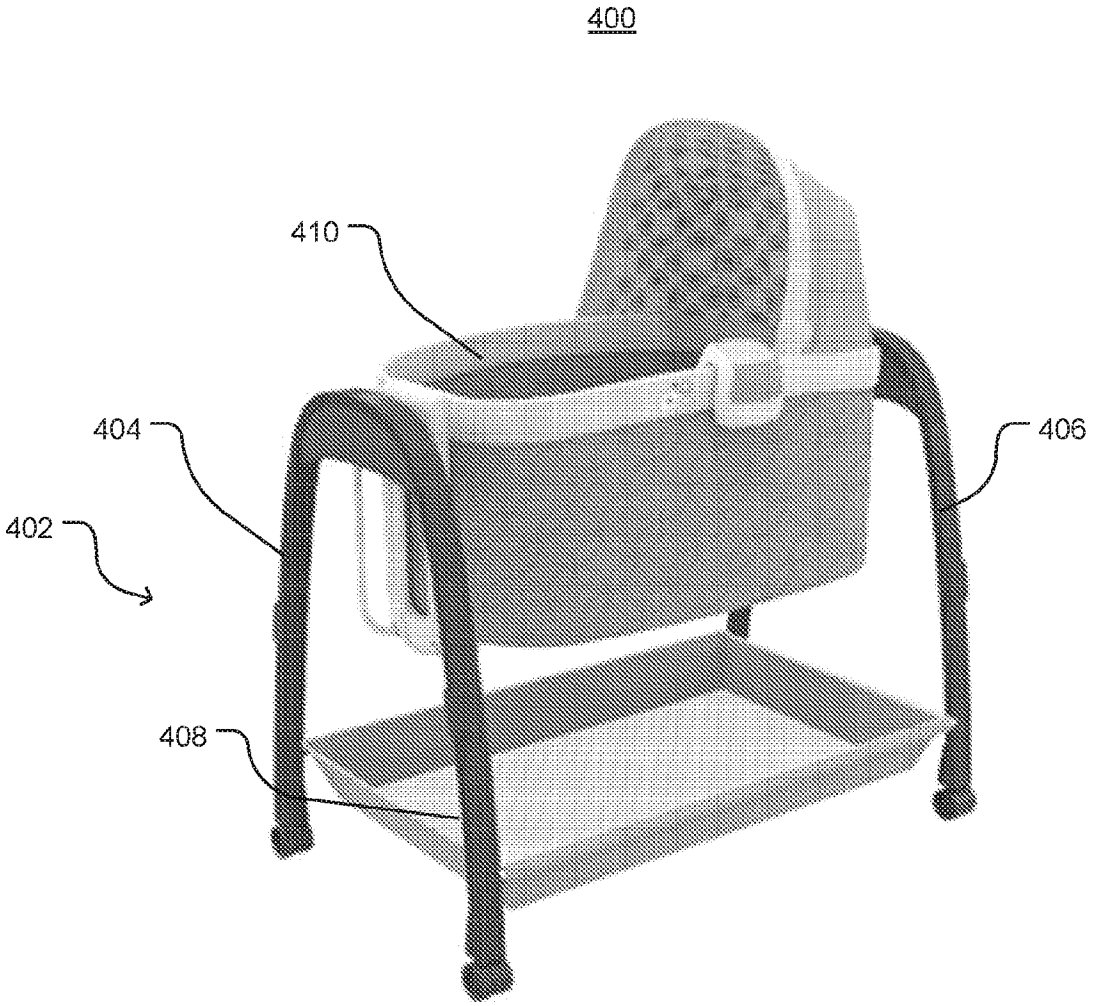
FIG. 4 is a perspective view of a child support device including a pivotable child receiving portion, according to an embodiment of the present disclosure.

Referring now to FIG. 4, a child support device 400 is shown. The child support device 400 can incorporate features of the child support devices 100, 200, 300. The child support device 400 includes a support frame 402 including a first pair of legs 404, a second pair of legs 406, and a basket 408 extending from the first pair of legs 404 to the second pair of legs 406.

The child support device 400 also includes a child receiving portion 410 that is pivotably coupled to the support frame 402. For example, the child support device 400 can include a pivot joint, ball joint, or other rotational coupler which attaches the child receiving portion 410 to the support frame 402 (e.g., to upper ends of the legs 404, 406).

Figure 12:
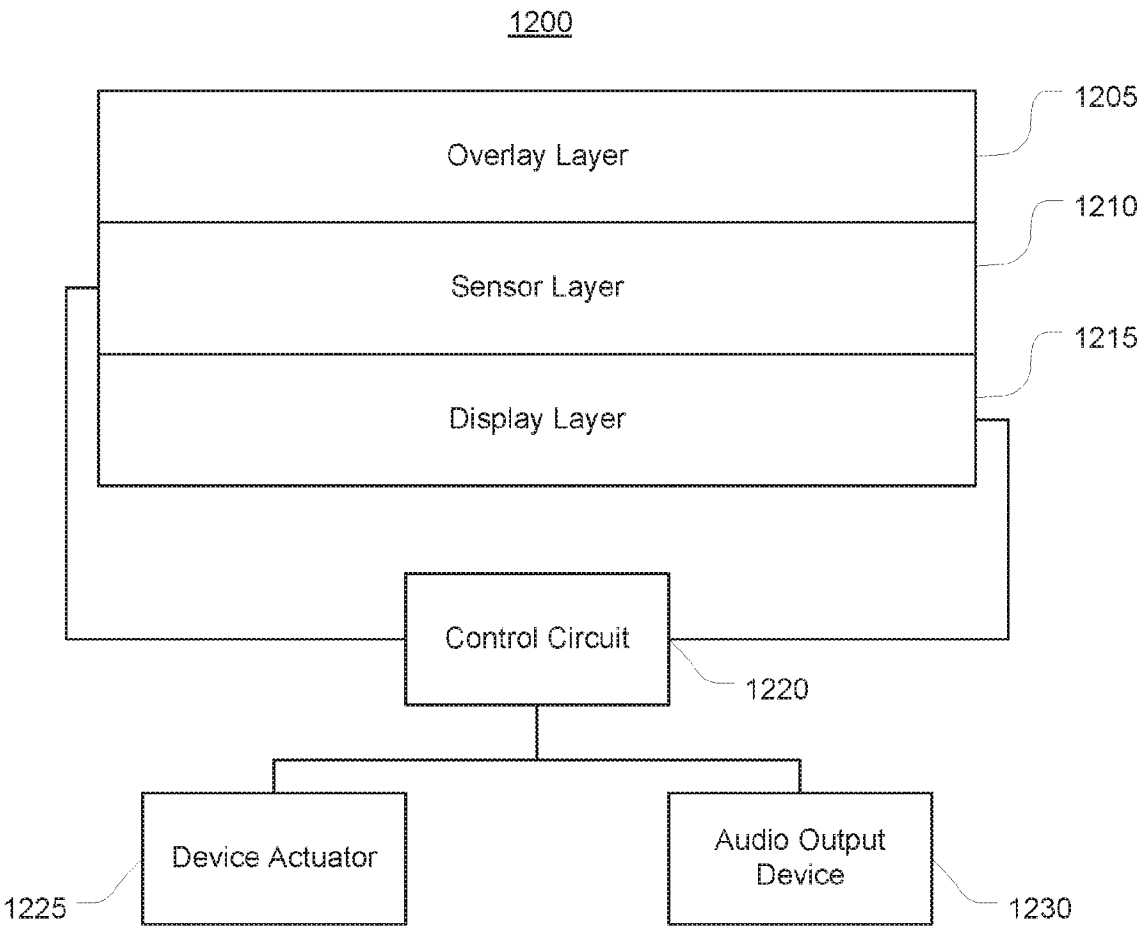
FIG. 12 is a block diagram of a capacitive touch device according to an embodiment of the present disclosure.
Figure 13:
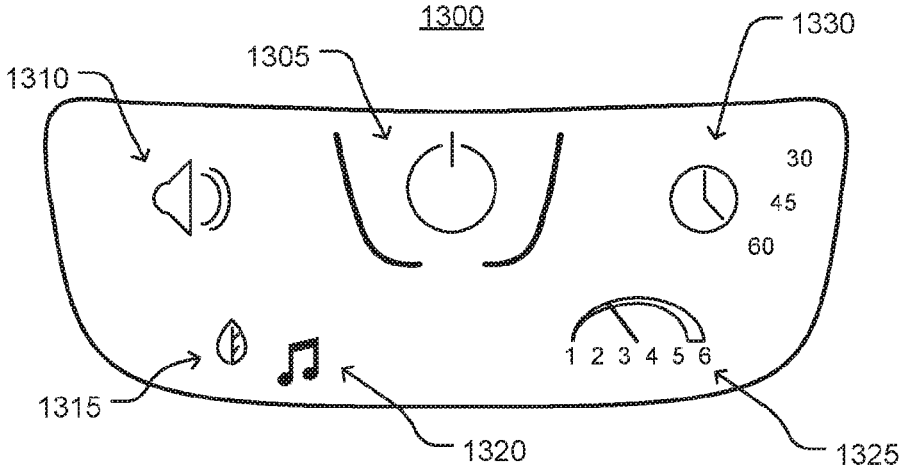
FIG. 13 is a schematic illustration of a capacitive touch device according to an embodiment of the present disclosure.
Figure 14:
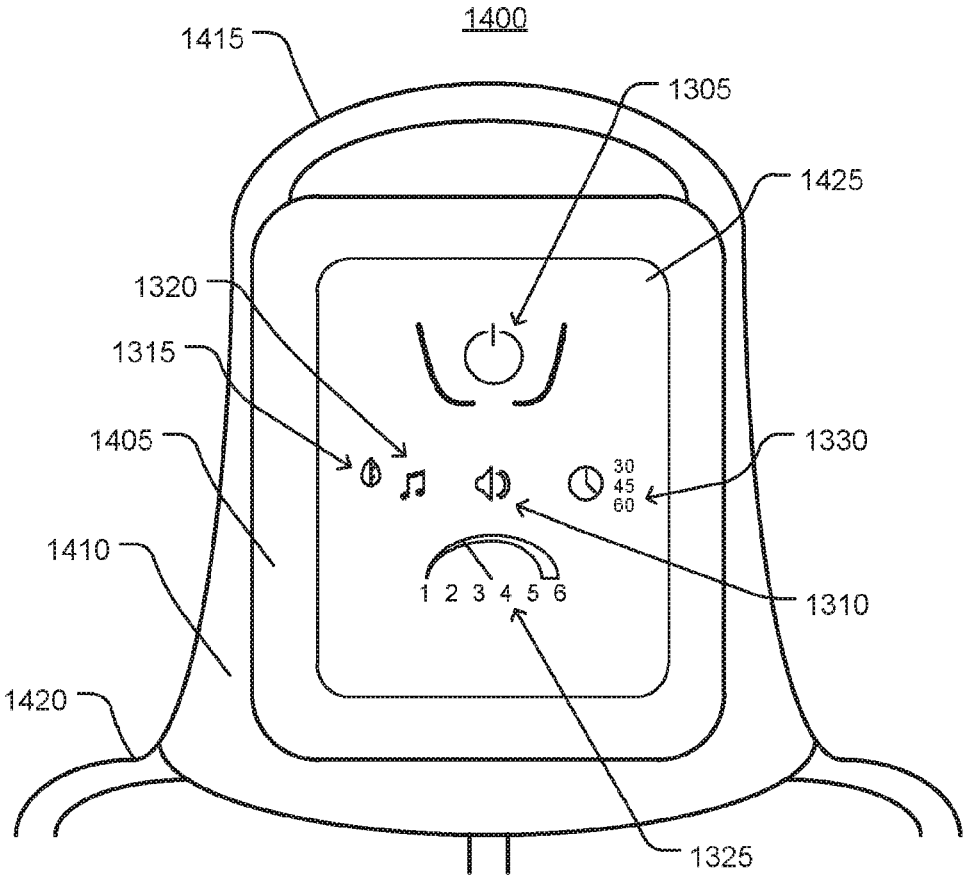
FIG. 14 is a schematic illustration of a capacitive touch device of a child support device according to an embodiment of the present disclosure.

Referring briefly to FIGS. 6-11, the child support device 400 can include a controller system (e.g., controller system 700) configured to control at least one of a speed or a magnitude of pivoting of the child receiving portion 410 about the support frame 402. Referring briefly to FIGS. 12-14, the child support device includes a capacitive touch device (e.g., capacitive touch device 1200) which can receive user input, and the swing control circuit can control the at least one of the speed or the magnitude of pivoting of the child receiving portion 410 based on the user input.

Figure 5:
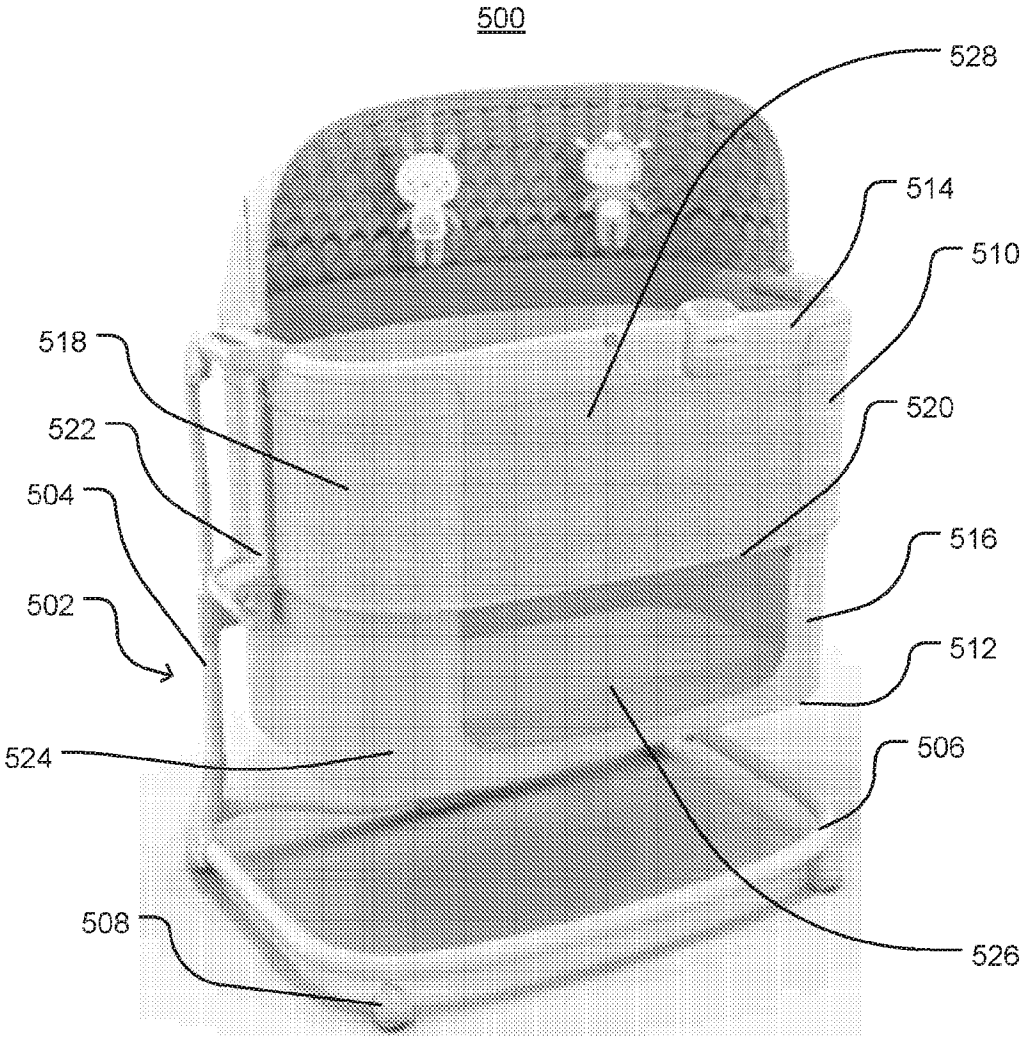
FIG. 5 is a perspective view of a child support device including a child receiving portion having an adjustable sidewall, according to an embodiment of the present disclosure.

Referring to FIG. 5, a child support device 500 is shown. The child support device 500 can incorporate features of the child support devices 100, 200, 300, 400. The child support device 500 includes a support frame 502 including at least one leg 504 extending from a base 506. The base 506 can include a plurality of rolling elements 508 (e.g., wheels).

The child support device 500 includes a child receiving portion 510 attached to the at least one leg 504. The child receiving portion 510 includes a floor 512, an upper member 514 spaced from the floor 512, a first sidewall 516 extending from the floor 512 to a first edge (not shown), and a second sidewall 518 extending from the upper member 514 to a second edge 520. The child support device 500 includes an adjustable member 522 configured to adjust a position of the first sidewall 516 relative to the second sidewall 518. In some embodiments, the adjustable member 522 is releasably coupled to one of the first sidewall 516 or the second sidewall 518, such that releasing the adjustable member 522 enables the first sidewall 516 to move relative to the second sidewall 518. For example, the adjustable member 522 can adjust the first sidewall 516 from a first position in which the upper member 514 is spaced from the floor 512 by a first distance to a second position in which the upper member 514 is spaced from the floor 512 by a second distance. As shown in FIG. 5, the first sidewall 516 can include a flexible portion 524 (e.g., similar to the first panel portion 212 of FIG. 2) and a layered mesh portion 526. The flexible portion 524 may vary in rigidity from being relatively flexible (e.g., more flexible than the layered mesh portion 526) to being relatively rigid (e.g., more rigid than the layered mesh portion 526). The second sidewall 518 can also include a layered mesh portion 528.

Motion Control Devices

Figure 6:
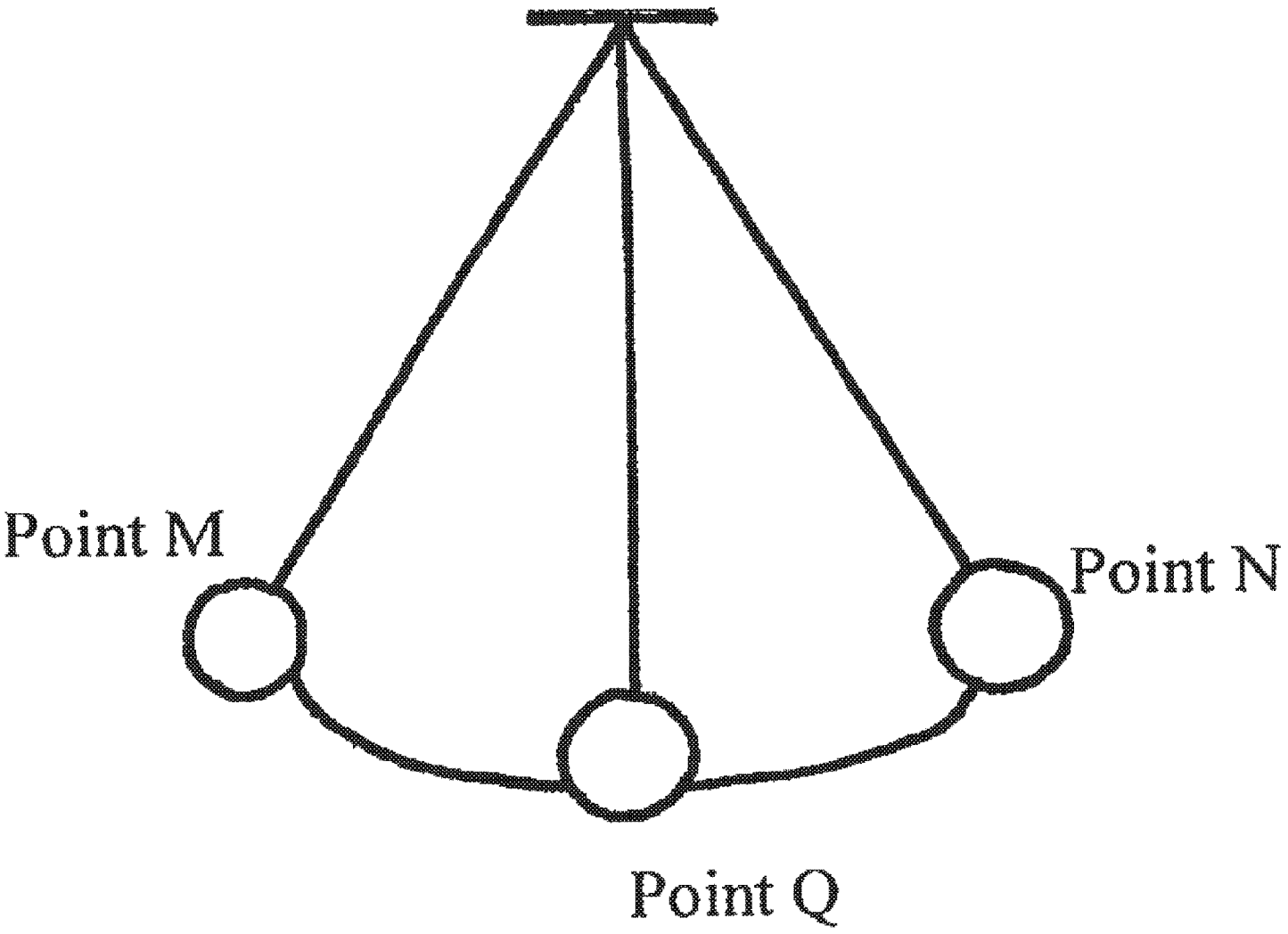
FIG. 6 is a diagram of a moving object configured as a pendulum according to an embodiment of the present disclosure.

In some embodiments, a drive mechanism can be provided to induce motion in child support devices (e.g., induce pendular motion in a rotatable arm, such as the pendulum as shown in FIG. 6. The pendulum in FIG. 6 travels in an arc. Points M and N on the arc represent the highest positions, at which points a speed of the pendulum is at a minimum. Point Q represents a point at which the pendulum is perpendicular with a line of the ground; at point Q, the speed of the pendulum is at a maximum. In some embodiments, the systems described herein can be used to control a speed of rotation of the rotatable arm. For example, a programmable controller (e.g., control circuit) can receive a signal indicating at least one of a rotation speed or an angular position, and control operation of a motor (e.g., control rotation speed and/or rotation direction) based on the signal, such as to provide a more smooth transition from zero speed (e.g., at points M and N) to maximum speed (e.g., at point Q) or vice versa. The control circuit can be configured to cause the motor to rotate in a reverse direction as a distance between the rotatable arm and point M or point N becomes less than a threshold distance, which may make the transition to the zero speed point more smooth (e.g., more linear). Similarly the control circuit can be configured to cause the motor to rotate at a lesser rotation speed as a distance between the rotatable arm and point Q becomes less than a threshold distance, which may make the transition to a maximum speed at point Q more smooth (e.g., more linear). In some embodiments, the control circuit can cause the rotatable arm to rotate at a speed which is smooth by controlling rotational acceleration of the rotatable arm to be continuous (e.g., any step changes in acceleration of the rotatable arm are less than a threshold), and/or by controlling rotational speed of the rotatable arm to have a sinusoidal or other smooth profile. In some embodiments, the control circuit can control operation of a magnetic drive system to output pulses of magnetic force (e.g., magnetic fields) to control speed, amplitude, or other parameters of the motion of the rotatable arm. It will be appreciated that systems in accordance with the present disclosure may include features of both the motion control systems described with reference to FIGS. 6-8 and the magnetic drive systems described with reference to FIGS. 9-11.

These systems, in some examples, include sensor assemblies which detect various characteristics of the motion (e.g., rotational motion of the rotatable arm) and generate signals in accordance with the detected various characteristics of the motion. These signals are then sent to the programmable controller of the drive mechanisms such that the programmable controller adjusts the driving force or the driving torque delivered by the driving mechanism.

In some embodiments, the power device or system includes a motor (e.g., a direct current motor). In some embodiments, the power device or system includes a magnetic drive system. For example, the magnetic drive system may include an electromagnetic drive system configured to generate both attractive and repulsive magnetic forces with another magnetic component of the magnetic drive system to drive motion of the moving object. In some embodiments, the magnetic drive system includes a solenoid drive system including an electromagnetic coil and a magnetic component configured to fit within the coil and generate a magnetic force to drive motion of the moving object.

The driving mechanism for driving motion of the moving object also includes a control device or control circuit configured to detect or monitor various motion characteristics of the motion of the moving object. For example, the control device or control circuit can be configured to detect characteristics of translational motion of the moving object, such as translational speed or velocity as well as translational distance traveled. In some embodiments, the control device or control circuit is configured to detect characteristics of rotational motion of the moving object, such as at least one of rotational amplitude, rotational speed, or velocity. The control device and control circuit can be configured to generate control signals for controlling the driving force or driving torque based on the detected characteristics.

DC Motor System

Figure 7:
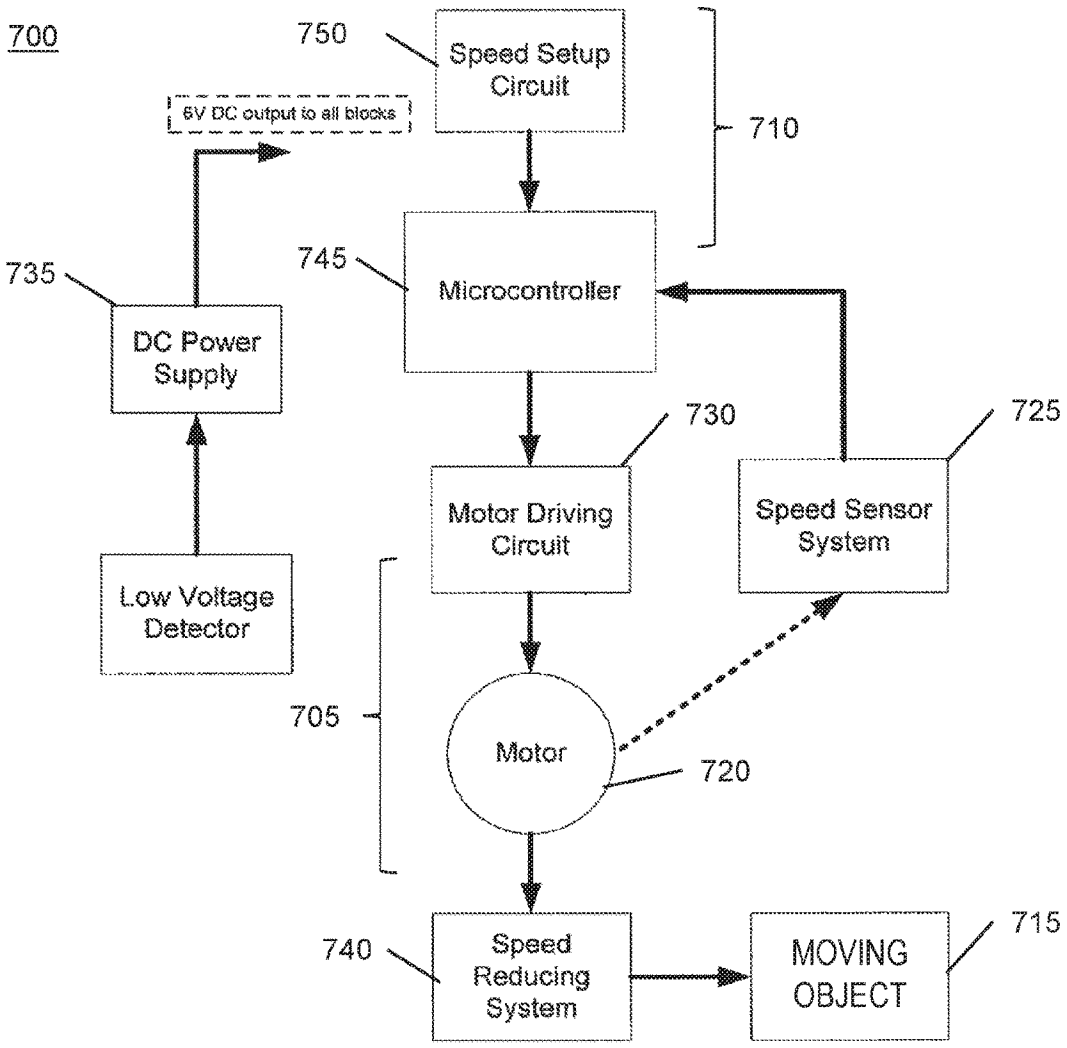
FIG. 7 is a diagram of a motion control system including a control device for motion of a moving object according to an embodiment of the present disclosure.

Referring to FIG. 7, a schematic of a controller system 700 including a motor system 705 and a control device 710 for motion of a moving object 715 is shown according to an embodiment of the present disclosure. As shown in FIG. 7, the system includes a motor 720 (e.g., a DC motor), a velocity sensor system (e.g., speed sensor system) 725, and a velocity control circuit (e.g., motor driving circuit) 730. The DC motor 720 is configured to provide a driving force or torque which is applied to the moving object 715. According to an embodiment, the system includes a speed controller including a power supply 735, the DC motor 720, a speed-reducing system (e.g., transmission) 740, a speed sensing system (e.g., speed sensor system 725), and an electronic control unit (e.g., microcontroller 745). The speed-reducing system 740 can be configured to control the motor power to the moving object 715, such as to mobilize the moving object 715 in at least one of a first (e.g., fore) or second (e.g., aft) direction. In some embodiments, the speed reducing system 740 includes a speed-reduction gear-set. In some embodiments, the speed setup circuit 750 is configured to receive a speed value (e.g., from a user input) and cause the microcontroller 745 to control operation of the motor 720 based on the speed value.

The speed sensor system 725 can be configured to measure the speed (e.g., rotational speed of the moving object 715) and output an electrical signal representative of the speed. For example, the speed sensor system 725 can include an optical sensor and an encoder wheel. The optical sensor can include a light source and a photodiode. The output signal of the photodiode may correspond to the swing speed information, and this output signal can be input to the electronic control circuit 745. The speed sensor system 725 may include magnetic sensors.

Figure 8:
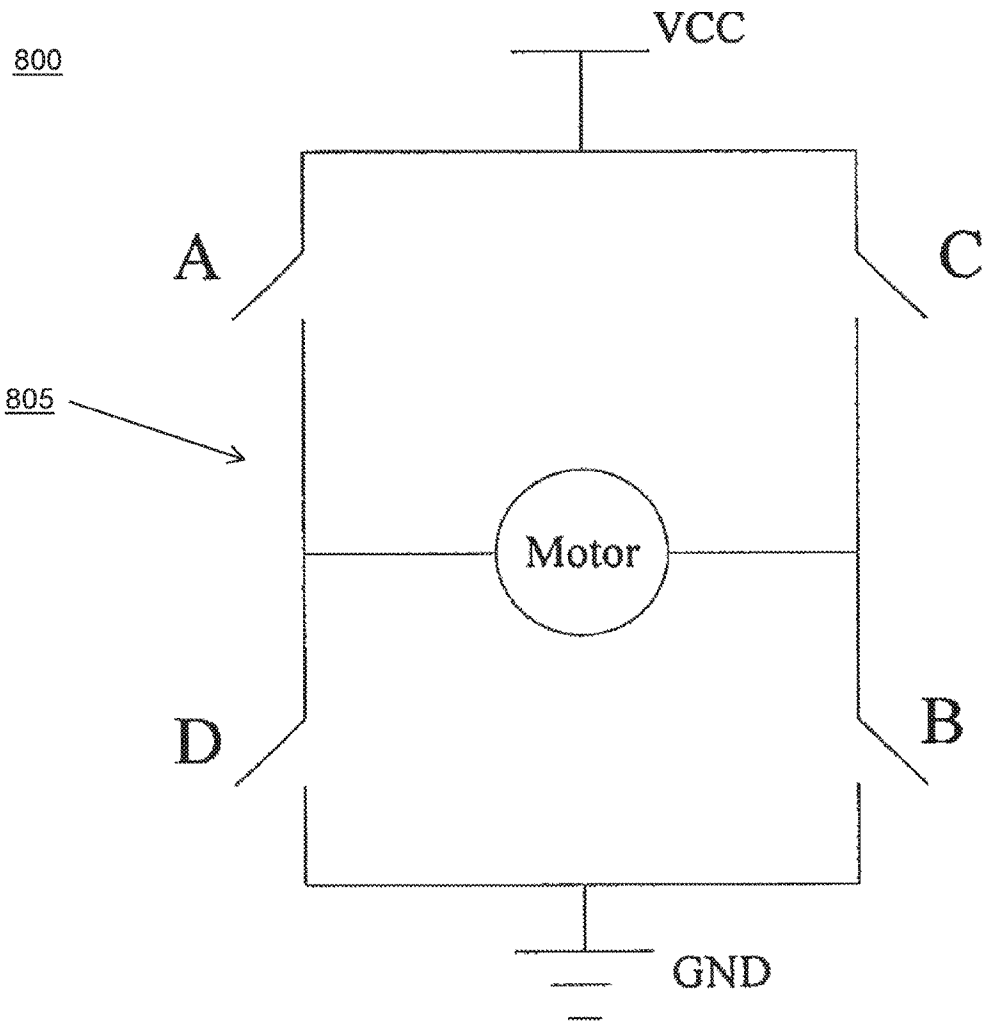
FIG. 8 is a diagram of a motor driving circuit for the motion control system shown in FIG. 6.

FIG. 8 illustrates a motor driving circuit 800 according to an embodiment of the present disclosure. The motor driving circuit 800 can be configured to interface with a DC motor (e.g., motor 720). As shown in FIG. 8, the motor driving circuit 800 may be implemented using an H-bridge circuit 805 to drive the DC motor 720. Switches (e.g., switches A, B, C, and D as shown in FIG. 7) can be either open or closed, resulting in a total of sixteen possible switch settings. By controlling the switches on/off in different combinations, the DC motor can be driven forward or backward or allowed to freewheel to mobilize the moving object in accordance with the desired operation. The speed setup circuit 750 of FIG. 7 can be configured to receive a user input indicating a desired speed for the moving object.

Magnetic Drive Systems

Figure 9:
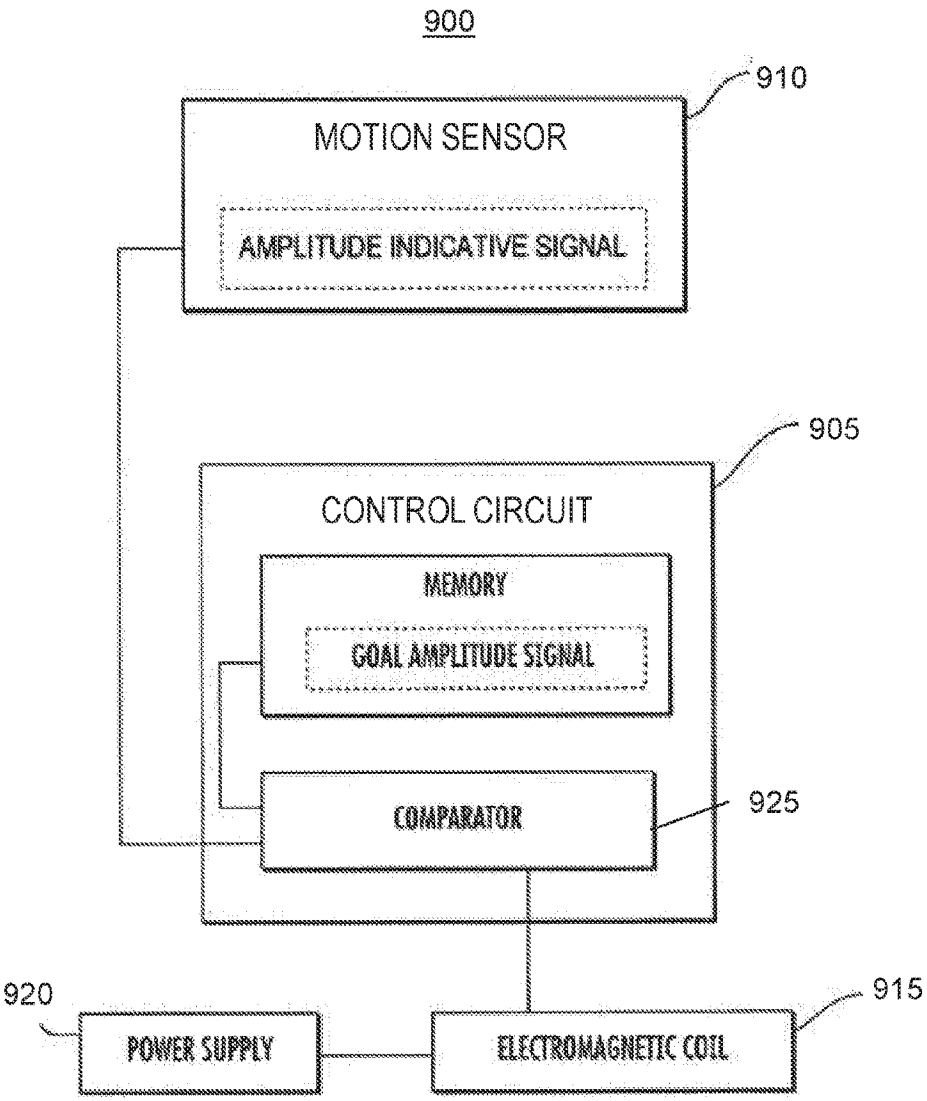
FIG. 9 is a schematic view of a motion control system including a magnetic drive system according to an embodiment of the present disclosure.
Figure 10:
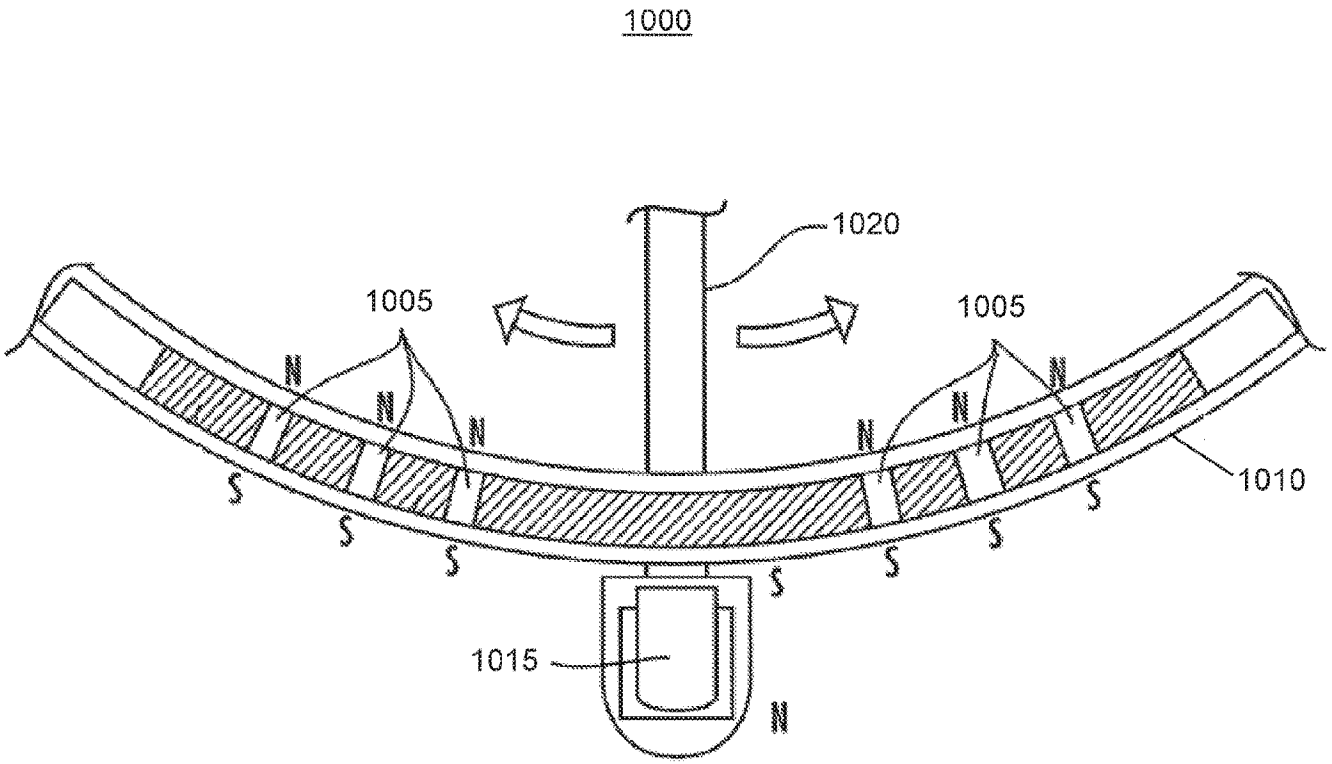
FIG. 10 is a cross-sectional view of an electromagnetic drive system for a rotatable arm according to an embodiment of the present disclosure.
Figure 11:
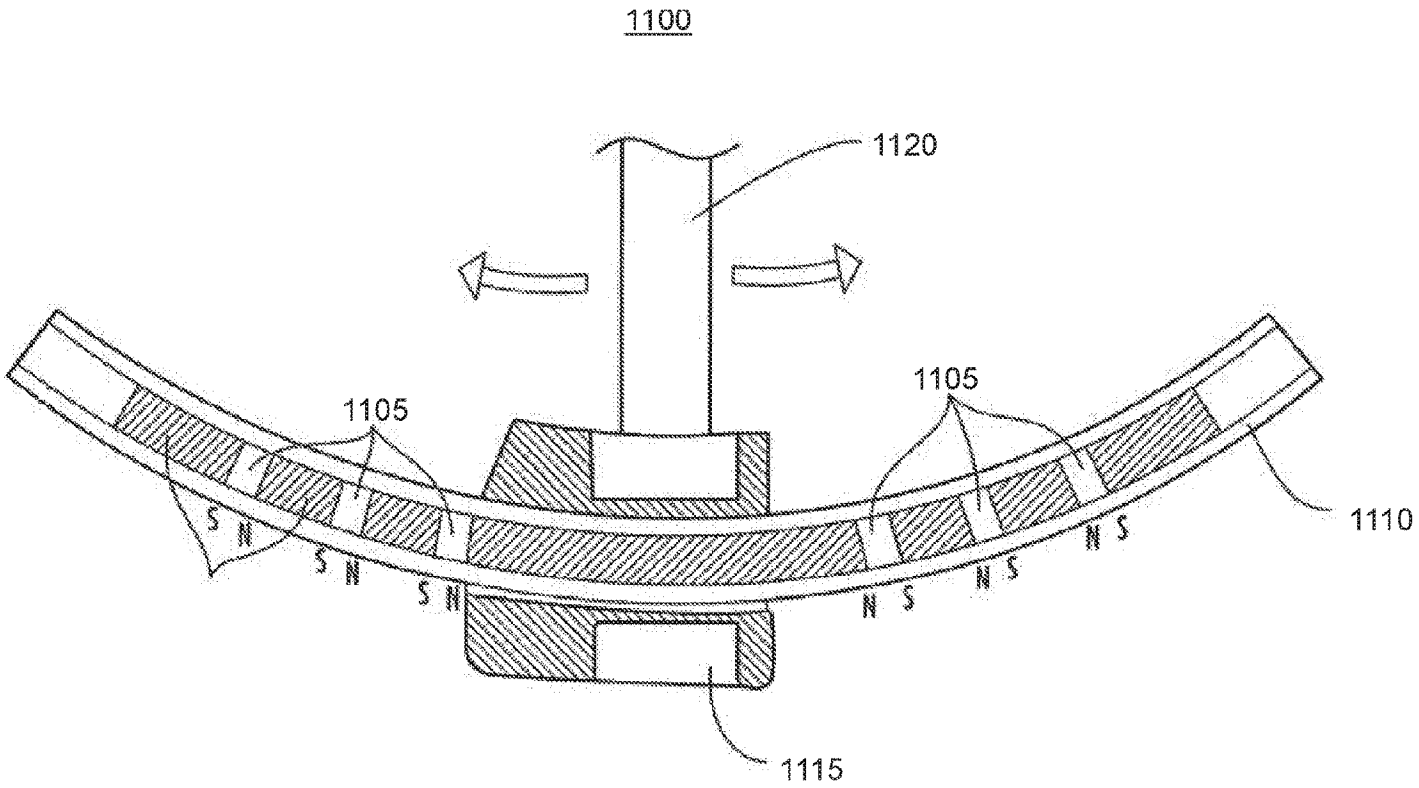
FIG. 11 is a cross-sectional view of a solenoid drive system for a rotatable arm according to an embodiment of the present disclosure.

Referring now to FIGS. 9-11, in various embodiments, drive systems can be configured to control movement of movable objects, such as rotatable arms. The drive system can be configured to cause the movable object to move with constant amplitude (e.g., by outputting electromagnetic pulses configured to apply controlled forces to the movable object), which may improve upon existing systems (e.g., DC motor systems). For example, magnetic drive systems may provide superior reliability and operate quietly. In some embodiments, the drive system includes an electromagnetic drive system. In some embodiments, the drive system includes a solenoid drive system.

FIG. 9 is a schematic illustration of a magnetic drive system 900 according to an embodiment of the present disclosure. The magnetic drive system includes control circuit 905, motion sensor 910, electromagnetic coil 915, and power supply 920. The control circuit 905 may include a memory device for storing a goal amplitude, and a comparator circuit 925 configured to compare a received amplitude signal to the goal amplitude to control operation of the electromagnetic coil 915 based on the comparison. The power supply 920 may include one or more batteries and/or may be connected to any suitable source of electric current (e.g., a plug-in AC/DC power supply). A direction of electric current supplied to the electromagnetic coil 915 dictates its polarity and pulses of electric current are transmitted to the electromagnetic coil 915. The pulses generate a magnetic force which repels the electromagnetic coil from a permanent magnet (not shown) which may be coupled to the movable object (e.g., moving object 715). For example, by repeatedly transmitting electric current to the electromagnetic coil 915 as it passes by the permanent magnet, a movable object can be driven along a predetermined motion path (e.g., a rotational motion path).

Electromagnetic Drive System

In some embodiments, an electromagnetic drive system includes a first magnetic component including a permanent magnet positioned in any suitable location (e.g., within a medial portion of a support member of the moving object). The permanent magnet includes any suitable magnet, such as a ferrous magnet stacked vertically with a neodymium magnet. The electromagnetic drive system may also include a second magnetic component including an electromagnetic coil, which can be positioned within a housing connected to the moving object. In some embodiments, the electromagnetic coil includes a metal core (such as steel, iron, etc.) to strengthen a magnetic force generated by the electromagnetic coil. In some embodiments, the electromagnetic drive system also includes a control circuit. The control circuit can be configured to receive signals from a user input control and motion sensor. The control circuit can be configured to generate control signals which control a motion of the movable object.

Referring now to FIG. 10, a cross-sectional side view of an electromagnetic drive system 1000 for driving a rotatable arm is shown according to an embodiment of the present disclosure. In some embodiments, the system includes a first magnetic component including two arrays of permanent magnets 1005 spaced apart within a support member 1010. Electromagnetic coil 1015 is operatively connected to the arm 1020, which is configured to rotate about a pivot point (not shown).

Solenoid Drive System

In some embodiments, the drive system includes a solenoid drive system. Herein the term "solenoid" refers to a type of electromagnet including an electromagnetic coil configured to wrap around a movable core (e.g., a permanent magnet). In some embodiments, a solenoid drive system includes a first magnetic component and a second magnetic component configured to generate a magnetic force which drives motion of a movable object. The first magnetic component includes a permanent magnet positioned within or adjacent to a structure connected to the movable object. The second magnetic component includes an electromagnetic coil.

The permanent magnet includes one or more suitable magnets and may be secured to the structure connected to the movable object. For example, the permanent magnet can include several, smaller permanent magnets, which may be connected together. In some embodiments, the several, smaller permanent magnets are arranged in an arcuate shape substantially parallel to a curvature or shape of the structure connected to the movable object.

In some embodiments, the electromagnet is configured to generate a magnetic force with the permanent magnet when electric power is supplied to the electromagnet by a power supply. The power supply includes any suitable source of electric current (e.g., batteries, plug-in AC/DC power supply). The solenoid drive system can be configured to cause pulses of electric current to be transmitted to the electromagnetic coil by the power supply, such as to provide a driving force or torque on the movable object. The solenoid drive system can allow the movable object to be driven by the reaction of the permanent magnet to a concentrated magnetic field present within a cavity of the electromagnetic coil. In some such embodiments, the magnetic force generated by the pulses is relatively strong. Additionally, by applying the magnetic force generated by the first and the second magnetic components, the system can reduce a force necessary to drive the movable object. These properties of the solenoid drive system can increase an overall efficiency of the system by requiring less power to drive motion of the movable object.

The solenoid drive system also includes a control circuit. The control circuit can be configured to receive signals from a user input control and motion sensor. The control circuit can be configured to generate control signals which control a motion of the movable object. The control signals generated by the control circuit are configured to control at least one of a timing, direction, or width of an electric current transmitted from the power supply to the electromagnet coil, such as for controlling pulses of magnetic forces outputted by the electromagnetic coil.

Referring now to FIG. 11, a cross-sectional side view of a solenoid drive system 1100 for driving a rotatable arm is shown according to an embodiment of the present disclosure. The system includes a first magnetic component including two arrays of permanent magnets 1105 spaced apart within the support member 1110, which is connected to a movable object or to a structure supporting the movable object. The control circuit can be configured to produce a driving torque by pulsing an electromagnetic coil 1115 as it moves along the support member 1110 between the permanent magnets 1105 arrays. Based on signals received from a motion sensor (not shown), the control circuit can determine a direction of the electromagnetic coil 1115 and reverses its polarity as an amplitude of an arm 1120 peaks and a direction of rotational motion changes. Electromagnetic coil 1115 may be pulsed and driven by the magnetic forces generated between it and the permanent magnets 1105 across a full range of motion of the electromagnetic coil 1115.

Capacitive Touch Device for Child Support Devices

In some embodiments, the devices described may include a capacitive touch device 1200 as shown in FIG. 12. The capacitive touch device 1200 includes an overlay layer 1205, a sensor layer 1210, and a display layer 1215. One or more of the overlay layer 1205, sensor layer 1210, and display layer 1215 can be manufactured from a flexible substrate, enabling the capacitive touch device 1200 to be installed in various arrangements tailored to the shape of the device in which the capacitive touch device 1200 is implemented.

The overlay layer 1205 may receive a user input (e.g., a touch, swipe, or other contact from a finger of a user, from a stylus, or any other object). The overlay layer 1205 can be transparent. The overlay layer 1205 can include glass, plastic, or other transparent (or partially transparent) materials, which may have a rigidity sufficient to protect the underlying sensor layer 1210 and display layer 1215 from damage due to repeated use cycles.

The sensor layer 1210 can generate a sensor signal based on the user input. The sensor signal can include an indication of a location at which the user input was received by the overlay layer 1205. The sensor signal can correspond to a change in capacitance of the sensor layer 1210 (or electrical components thereof) resulting from the user input. The sensor layer 1210 can generate the sensor signal based on capacitive coupling between the object contacting the overlay layer 1205 and the sensor layer 1210. The sensor layer 1210 can generate the sensor signal using surface capacitance or projected capacitance. The sensor layer 1210 can include a conductor (e.g., indium tinoxide (ITO)) which acts as a capacitive layer. The sensor layer 1210 can include a plurality of capacitive layers (which may be separated by corresponding insulating layers). The sensor layer 1210 can include a transparent substrate to allow light outputted by the display layer 1215 to be transmitted through the sensor layer 1210 into the overlay layer 1205.

The display layer 1215 displays images to be outputted through the sensor layer 1210 and overlay layer 1205 for viewing by a user. The sensor layer 1210 can be patterned on or placed over the display layer 1215. The display layer 1215 can include a display device such as a liquid crystal display (LCD), light emitting diode display (LED), organic light emitting diode display (OLED), or any other display device.

In some embodiments, the capacitive touch device 1200 includes a control circuit 1220. The control circuit 1220 can include a processor and memory. The processor may be implemented as a specific purpose processor, an application specific integrated circuit (ASIC), one or more field programmable gate arrays (FPGAs), a group of processing components, or other suitable electronic processing components. The memory is one or more devices (e.g., RAM, ROM, flash memory, hard disk storage) for storing data and computer code for completing and facilitating the various user or client processes, layers, and modules described in the present disclosure. The memory may be or include volatile memory or non-volatile memory and may include database components, object code components, script components, or any other type of information structure for supporting the various activities and information structures of the inventive concepts disclosed herein. The memory is communicably connected to the processor and includes computer code or instruction modules for executing one or more processes described herein. The memory includes various circuits, software engines, and/or modules that cause the processor to execute the systems and methods described herein, including controlling operation of the display layer 1215 and a device actuator 1225.

The control circuit 1220 can control operation of the display layer 1215. For example, the control circuit 1220 can output a display signal to the display layer 1215 to display image(s) based on the display signal. The control circuit 1220 can include a display database including the images to be displayed by the display layer 1215. The control circuit 1220 can receive the images to be displayed from a remote source (e.g., via communications electronics, not shown). As will be described further herein with reference to FIGS. 13 and 14, the control circuit 1220 can cause the display layer 1215 to display icons, animations, or other visual indicators corresponding to commands to be received by the capacitive touch device 1200.

In some embodiments, the control circuit 1220 receives the sensor signal from the sensor layer 1210. The control circuit 1220 can extract a location of the user input from the sensor signal. For example, the sensor signal may include the location of the user input (e.g., a two-dimensional coordinate location corresponding to the surface of the overlay layer 1205). The control circuit 1220 can determine the location of the user input based on the sensor signal; for example, the sensor signal may include one or more voltage values which the control circuit 1220 can use to retrieve the location of the user input from a database (e.g., lookup table stored in a database) mapping voltage values to user input locations.

The control circuit 1220 can determine a command indicated by the user input based on the location of the user input. For example, control circuit 1220 can perform a lookup in a command database based on the location of the user input to determine the command. In some embodiments, the command database may correspond to the images of the display database. For example, the control circuit 1220 can reconfigure the command database in response to changes to the display database (or images stored therein), so that the control circuit 1220 can dynamically manage user inputs received even as the arrangement of the image displayed by the display device 1215 change. As such, the control circuit 1220 can determine which visual indicator (e.g., icon) displayed by the display device 1215 was selected based on the user input.

The control circuit 1220 can control operation of the display layer 1215 based on the command. For example, the control circuit 1220 can determine that the command indicates instructions to modify an image displayed by the display layer 1215, and in response, modify the display signal based on the command. The control circuit 1220 can determine that the command indicates instructions to modify operational parameters of the display layer 1215. The operational parameters may include a power state, such as on, off, or sleep mode. The operational parameters may include a display brightness (which may include a sleep state which is relatively dim compared to a normal operational state).

The control circuit 1220 can control operation of an audio output device 1230 based on the command. For example, the control circuit 1220 can control an operational state of the audio output device 1230 (e.g., on, off, volume level). The control circuit 1220 can retrieve an audio file from an audio database based on the command, and cause the audio output device 1230 to play the audio file.

In some embodiments, the control circuit 1220 controls operation of a device actuator 1225 based on the command. The device actuator 1225 can include a motor or other drive mechanism for controlling movement of a movable member (e.g., swing arm, door). The control circuit 1220 can control parameters of movement of the movable member (e.g., speed, direction, duration) using the device actuator 1225.

Referring now to FIG. 13, one embodiment of a capacitive touch device 1300 is shown. The capacitive touch device 1300 can incorporate features of the capacitive touch device 1200 described with reference to FIG. 12.

As shown in the depicted embodiment, the capacitive touch device 1300 can display one or more visual indicators (e.g., icons, display elements), which can be associated with commands that the capacitive touch device 1300 can execute based on receiving user inputs located at or near the visual indicators. The capacitive touch device 1300 can receive a user input corresponding to a selection of a visual indicator. The capacitive touch device 1300 can identify a location of the user input, and determine the selection of the visual indicator based on the location of the user input. The capacitive touch device 1300 can determine a command corresponding to the visual indicator. For example, the capacitive touch device 1300 can determine a command to control movement of a moveable member of the devices described herein, such as a swing arm, and control operation of the swing arm based on the command (e.g., using device actuator 1225 of FIG. 12).

As shown in FIG. 13, the capacitive touch device 1300 can include various visual indicators including one or more of a power indicator 1305, a volume indicator 1310, an energy efficiency indicator 1315, an audio indicator 1320, a speed indicator 1325, and a time indicator 1330. The capacitive touch device 1300 can receive user inputs as touches located on or near the visual indicators, where the user inputs correspond to actions associated with the visual indicators.

The power indicator 1305 can indicate a power state of an apparatus incorporating or in communication with the capacitive touch device 1300 (e.g., on state, off state, sleep state). The capacitive touch device 1300 can receive a user input at the power indicator 1305 and modify the power state based on the user input (e.g., change between on, off, and/or sleep states).

The volume indicator 1310 can indicate a volume level of an audio output device in communication with the capacitive touch device 1300. The capacitive touch device 1300 can receive a user input at the volume indicator 1310 and modify a volume level of the audio output device based on the user input (e.g., increase volume, decrease volume, mute).

The energy efficiency indicator 1315 can indicate whether the capacitive touch device 1300 (or an apparatus incorporating the capacitive touch device 1300) is operating in an energy efficient state (e.g., the apparatus may include a regenerative braking mechanism, which can recharge a power source, such as a battery, based on motion of a movable member). The capacitive touch device 1300 can receive a user input at the energy efficiency indicator 1315 and modify an energy efficiency state based on the user input (e.g., activate or deactivate regenerative braking; switch to sleep state).

The audio indicator 1320 can indicate whether audio is being played. The capacitive touch device 1300 can receive a user input at the audio indicator 1320 and modify audio play based on the user input (e.g., turn audio output on or off; select and/or change audio being played).

The speed indicator 1325 can indicate a current speed value (e.g., absolute speed or relative speed), or a gear state associated with movement of a movable member, such as a swing arm, wall, gate, or play surface. The capacitive touch device 1300 can receive a user input at the speed indicator 1325 and modify the current speed value or gear state based on the user input.

The time indicator 1330 can indicate a duration of time for which the movable member is to be in motion. The capacitive touch device 1300 can receive a user input at the time indicator 1330 and modify operation the duration of time based on the user input.

Referring now to FIG. 14, a movement device 1400 is shown according to an embodiment of the present disclosure. The movement device 1400 can incorporate features of the capacitive touch devices 1200, 1300 described with reference to FIGS. 12 and 13, respectively. As shown in FIG. 14, the movement device 1400 includes a display member 1405. A capacitive touch device 1425 is attached to the display member 1405. The movement device 1400 includes a base 1410 to which the display member 1405 can be attached to or extend from. In some embodiments, the base 1410 includes a handle member 1415. The base 1410 may also include one or more arms 1420 extending from the base 1410. The arm(s) 1420 can be (or be coupled to) movable members that can be moved based on a user input received by the capacitive touch device 1425. The capacitive touch device 1425 can display one or more visual indicators 1305, 1310, 1315, 1320, 1325, 1330, and receive user inputs corresponding to the one or more visual indicators.

The preceding detailed description and the appended drawings describe and illustrate various child support devices and components. The description and drawings are provided to enable one of skill in the art to make and use one or more child support devices and/or components, and/or practice one or more methods. They are not intended to limit the scope of the claims in any manner.

What is claimed is:

1. A child support device, comprising:

a seat; and a panel included in or adjacent to the seat, the panel including:

a first panel portion including a panel edge defining a panel opening, the first panel portion having a first heat transfer coefficient, a location of the panel opening corresponding to a heat transfer region in which an expected heat received from a child in the seat is greater than a heat reception threshold; and a second panel portion in the panel opening and attached to the panel edge, the second panel portion including a layered mesh having a second heat transfer coefficient greater than the first heat transfer coefficient and greater than a threshold heat transfer coefficient at which a temperature of the second panel portion while receiving the expected heat is greater than a room temperature by less than a threshold difference, wherein the threshold difference is at most five degrees Fahrenheit;

wherein the layered mesh comprises:

a first layer of material having a first mesh size, a second layer of material having a second mesh size, and an intermediate layer of material positioned between the first layer and the second layer and having a third mesh size.

2. The support panel of claim 1, wherein the first panel portion has a first stiffness, the second panel portion has a second stiffness less than the first stiffness, and a ration of a surface area of the first panel portion to a surface area of the second panel portion is greater than a threshold ration at which an average stiffness of the panel is at least a threshold percentage of the first stiffness, wherein the threshold percentage is at least fifty percent.

3. The child support device of claim 1, wherein the panel is a back panel adjacent to and integrally formed with the seat.

4. The child support device of claim 1, wherein the second panel portion reduces a brightness of visible light passing through the second panel portion towards the seat by at least thirty percent.

5. The child support device of claim 1, further comprising an upper member attached to the first panel portion, the upper member having a third heat transfer coefficient greater than or equal to the second heat transfer coefficient.

6. The child support device of claim 1, wherein the first panel portion has a first stiffness, the second panel portion has a second stiffness greater than the first stiffness, and a ratio of a surface area of the first panel portion to a surface area of the second panel portion is greater than a threshold ratio at which an average stiffness of the panel is at least a threshold percentage of the second stiffness, wherein the threshold percentage is at least fifty percent.

7. A bassinet, comprising:

a support frame comprising at least one leg; and a child receiving portion supported by the at least one leg of the support frame, the child receiving portion comprising an upper frame member, a floor for supporting a child within the child receiving portion spaced apart from the upper frame member, and a sidewall extending between the upper frame member and the floor, the sidewall including a layered mesh having a light transmittance coefficient, wherein the light transmittance coefficient is (1) less than a first threshold at which brightness of light passing into the child-receiving portion via the layered mesh decreases by thirty percent and (2) greater than a second threshold at which the layered mesh is opaque to a view point outside the child-receiving portion and located along an axis passing through the child receiving portion and the layered mesh;

wherein the layered mesh comprises:

a first layer of material having a first mesh size, a second layer of material having a second mesh size, and an intermediate layer of material positioned between the first layer and the second layer and having a third mesh size.

8. The bassinet of claim 7, wherein the view point is greater than two feet and less than ten feet away from the sidewall.

9. The bassinet of claim 7, wherein the layered mesh is located at a heat transfer region in which an expected heat received from a child in the seat is greater than a heat reception threshold.

10. The bassinet of claim 7, further comprising a canopy extending over the child receiving portion, the canopy including a canopy layered mesh having a canopy light transmittance coefficient less than the first threshold and greater than the second threshold.

11. The bassinet of claim 7, wherein the child receiving portion is pivotably coupled to the support frame.

12. The bassinet of claim 11, further comprising a swing control circuit configured to control at least one of a speed or a magnitude of pivoting of the child receiving portion relative to the at least one leg.

13. The bassinet of claim 11, further comprising a capacitive touch device, wherein the swing control circuit is configured to control the at least one of the speed or the magnitude based on a user input received via the capacitive touch device.

14. The bassinet of claim 7, further comprising an adjustable member coupled to the sidewall and the upper frame member, the adjustable member configured to adjust the sidewall from a first position in which the upper frame member is spaced a first distance from the floor to a second position in which the upper frame member is spaced a second distance from the floor.

15. The bassinet of claim 7, wherein the at least one leg includes a first pair of legs adjacent to a first end of the child receiving portion and a second pair of legs adjacent to a second end of the child receiving portion.

16. The bassinet of claim 7, wherein the sidewall further comprises a panel including a first non-woven layer, a second polyester layer, and a third tactile layer, the panel having a first stiffness, the layered mesh having a second stiffness, the sidewall having an average stiffness which is at least fifty percent of the first stiffness.

17. A child support device, comprising:

a plurality of legs; and a child receiving portion including an upper frame member coupled to the plurality of legs, a floor spaced from the upper frame member, and a sidewall extending between the floor and upper frame member, the sidewall configured to reduce a brightness of light through the sidewall by at least thirty percent, the sidewall having a heat transfer coefficient greater than a threshold value at which a temperature of the sidewall while receiving an expected heat corresponding to a child in the child receiving portion is no greater than eighty degrees Fahrenheit, wherein the sidewall includes a layered mesh;

wherein the layered mesh comprises:

a first layer of material having a first mesh size, a second layer of material having a second mesh size, and an intermediate layer of material positioned between the first layer and the second layer and having a third mesh size.

18. The child support device of claim 17, wherein the floor includes a layered mesh.

19. The child support device of claim 17, wherein the layered mesh forms less than half of the surface area of the sidewall.

* * * * *